US011002157B2

(12) United States Patent
Persson

(10) Patent No.: US 11,002,157 B2
(45) Date of Patent: May 11, 2021

(54) ROCKER ARM FOR AN INTERNAL COMBUSTION ENGINE

(71) Applicant: VOLVO TRUCK CORPORATION, Gothenburg (SE)

(72) Inventor: Per Persson, Partille (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 46 days.

(21) Appl. No.: 16/493,824

(22) PCT Filed: Mar. 27, 2017

(86) PCT No.: PCT/EP2017/057203
§ 371 (c)(1),
(2) Date: Sep. 13, 2019

(87) PCT Pub. No.: WO2018/177499
PCT Pub. Date: Oct. 4, 2018

(65) Prior Publication Data

US 2020/0131946 A1 Apr. 30, 2020

(51) Int. Cl.
*F01L 1/24* (2006.01)
*F01L 1/18* (2006.01)
(Continued)

(52) U.S. Cl.
CPC ..... *F01L 1/24* (2013.01); *F01L 1/181* (2013.01); *F01L 1/2411* (2013.01);
(Continued)

(58) Field of Classification Search
CPC . F01L 13/065; F01L 1/181; F01L 1/24; F01L 13/06; F01L 1/2411; F01L 1/2422;
(Continued)

(56) References Cited

U.S. PATENT DOCUMENTS 5,609,133 A * 3/1997 Håkansson ..... F01L 1/2411 123/321
6,422,186 B1 * 7/2002 Vanderpoel ..... F01L 1/2411 123/90.15

(Continued)

FOREIGN PATENT DOCUMENTS

CN 104685170 A 6/2015
CN 105003314 A 10/2015
CN 106382140 A 2/2017

OTHER PUBLICATIONS

International Search Report and Written Opinion dated Nov. 24, 2017 in International Application No. PCT/EP2017/057203.

(Continued)

*Primary Examiner* — Patrick Hamo
*Assistant Examiner* — Wesley G Harris
(74) *Attorney, Agent, or Firm* — Venable LLP; Jeffri A. Kaminski

(57) ABSTRACT

The present invention relates to a rocker arm (16) for an internal combustion engine (12). The rocker arm (16) comprises a cavity (41) with a cavity wall (42) at least partially accommodating a lash adjustment piston (44) for hydraulic lash adjustment. The rocker arm (16) further comprises a lash stop surface (46). At least a portion of the lash adjustment piston (44) is adapted to abut the lash stop surface (46) during at least one operating condition of the rocker arm (16). The cavity (41) comprises a lash adjustment chamber (50) at least partially delimited by the lash adjustment piston (44). The rocker arm (16) further comprising a control fluid conduit (52) and a valve assembly (54) located between the lash adjustment chamber (50) and the control fluid conduit (52), as seen in an intended direction of flow from the control fluid conduit (52) to the lash adjustment chamber (50).

27 Claims, 12 Drawing Sheets

(51) Int. Cl.
*F02D 13/02* (2006.01)
*F01L 1/26* (2006.01)
*F01L 13/06* (2006.01)

(52) U.S. Cl.
CPC ..... *F02D 13/0203* (2013.01); *F01L 1/267* (2013.01); *F01L 13/06* (2013.01); *F01L 2820/043* (2013.01); *F02D 2200/024* (2013.01)

(58) Field of Classification Search
CPC .. F01L 1/2405; F01L 13/0005; F01L 2305/00
USPC ..... 123/90.16, 90.39, 90.55, 90.46
See application file for complete search history.

(56) References Cited

U.S. PATENT DOCUMENTS 6,439,195 B1 * 8/2002 Warner ..... F02D 13/04 123/321
6,450,144 B2 * 9/2002 Janak ..... F01L 13/065 123/321
6,983,725 B2 * 1/2006 Persson ..... F01L 13/06 123/90.16
8,499,740 B2 * 8/2013 Yoon ..... F01L 13/06 123/321
8,887,679 B2 * 11/2014 Girard ..... F01L 13/06 123/90.39
8,991,350 B2 * 3/2015 Yang ..... F01L 1/08 123/90.39
9,163,534 B2 * 10/2015 Girard ..... F01L 1/46
2004/0231639 A1 11/2004 Israel et al.
2011/0023821 A1 * 2/2011 Yoon ..... F01L 1/181 123/321
2011/0290206 A1 * 12/2011 Meistrick ..... F01L 1/2411 123/90.46
2012/0048221 A1 3/2012 Jeon et al.
2015/0122220 A1 * 5/2015 Cecur ..... F01L 1/2411 123/321

OTHER PUBLICATIONS

China Office Action dated Mar. 1, 2021 in corresponding China Patent Application No. 201780089068.3, 11 pages.

* cited by examiner

ROCKER ARM FOR AN INTERNAL COMBUSTION ENGINE

TECHNICAL FIELD

The invention relates to a rocker arm for an internal combustion engine. Moreover, the present invention relates to each one of an inlet rocker arm, an exhaust rocker arm and a rocker arm assembly for an internal combustion engine. Further, the present invention relates to a method for controlling a lash in a rocker arm for an internal combustion engine.

The invention can be applied in heavy-duty vehicles, such as trucks, buses and construction equipment. Although the invention will be described with respect to a truck, the invention is not restricted to this particular vehicle, but may also be used in other vehicles such as working machines or boats.

BACKGROUND

An internal combustion engine, such as a diesel engine, generally comprises a set of cylinders. Moreover, the internal combustion engine generally comprises a set of valves associated with each one of the cylinders. For instance, the internal combustion engine may comprise a set of inlet valves and a set of exhaust valves associated with each cylinder of the internal combustion engine.

Traditionally, each valve has a fixed valve lift which is set in order to achieve an appropriate fuel economy for a plurality of internal combustion engine operating conditions.

However, for certain operating conditions, it would be desired to change the valve lift of at least one of the valves associated with at least one cylinder. For instance, during low load such as idling, it may be desired to alter the valve lift of one or more of the inlet valves associated with a cylinder in order to increase the exhaust gas temperatures to thereby ensure that an exhaust gas after treatment system can operate in a desired manner. The valve lift may be adjusted by altering a distance between a rocker arm and a lash adjustment piston connected to the one or more valves.

As another example, during engine braking for instance, it may be desired to alter the valve lift of one or more of the exhaust valves associated with a cylinder in order to increase an engine braking capacity of the engine.

To this end, systems have been developed for controlling the displacement of valves of an internal combustion engine. For instance, US 2004/0231639 A1 discloses a variable valve actuation system by which the displacement of the exhaust valves can be controlled. However, it is desired to obtain an improved arrangement for controlling the movement of at least one valve of an internal combustion engine.

SUMMARY

In view of the above, an object of the present invention is to obtain an arrangement by which the valve lift of one or more valves of a cylinder of an internal combustion engine can be varied in a desired manner.

The object is achieved by a rocker arm according to claim 1.

As such, the present invention relates to a rocker arm for an internal combustion engine. The rocker arm comprises a cavity with a cavity wall at least partially accommodating a lash adjustment piston for hydraulic lash adjustment. The rocker arm further comprises a lash stop surface, at least a portion of the lash adjustment piston being adapted to abut the lash stop surface during at least one operating condition of the rocker arm. The cavity comprises a lash adjustment chamber at least partially delimited by the lash adjustment piston. The rocker arm further comprises a control fluid conduit and a valve assembly located between the lash adjustment chamber and the control fluid conduit, as seen in an intended direction of flow from the control fluid conduit to the lash adjustment chamber.

According to the invention, the valve assembly is such that:

- for a first fluid pressure range wherein a fluid pressure in the control fluid conduit is equal to or lower than a first predetermined threshold pressure level, the lash adjustment piston can move relative to the cavity wall in at least a direction towards the lash stop surface;
- for a second fluid pressure range from and including a low second predetermined threshold pressure level to and including a high second predetermined threshold pressure level, the low second predetermined threshold pressure level being greater than the first predetermined threshold pressure level, the lash adjustment piston is prevented from moving relative to the cavity wall in at least a direction towards the lash stop surface, and
- for a third fluid pressure range wherein the fluid pressure in the control fluid conduit exceeds a third predetermined threshold level, the third predetermined threshold level being greater than the high second predetermined threshold pressure level, the lash adjustment piston can move relative to the cavity wall in at least a direction towards the lash stop surface.

The rocker arm according to the present invention implies that a lash adjustment may be achieved in an appropriate manner. In particular, the fact that the rocker arm is such that the lash adjustment piston can move relative to the cavity wall, in at least a direction towards the lash stop surface, for each one of the first and third pressure ranges, implies a versatile lash control for a plurality of rocker arms that are connected to the same source of control fluid.

As a non-limiting example, the lash adjustment piston may be prevented from moving relative to the cavity wall in at least a direction towards the lash stop surface by virtue of the fact that fluid in the lash adjustment chamber prevents the lash adjustment piston from moving relative to the cavity wall in at least a direction towards the lash stop surface.

Purely by way of example, if two or more rocker arms are connected to the same source of control fluid, the first, second and third pressure ranges may be individually set for the two or more rocker arms. This in turn implies that a plurality of different lash configurations can be achieved by the two or more rocker arms, for instance configurations wherein the lash adjustment piston of one of the rocker arms is fixed at the same time as the lash adjustment piston of another one of the rocker arms is moveable, and vice versa, by controlling the pressure provided by a single source of control fluid.

Optionally, the valve assembly is such that for the first fluid pressure range, the valve assembly prevents fluid to flow from the control fluid conduit to the lash adjustment chamber. As such, the movability of the lash adjustment piston may be obtained by ensuring that the control fluid does not reach the lash adjustment chamber for the first fluid pressure range.

Optionally, the valve assembly is such that for the first fluid pressure range, the valve assembly allows fluid to flow from the lash adjustment chamber to a drain channel. The possibility to drain fluid from the lash adjustment chamber implies that the lash adjustment piston may be allowed to be moved in at least a direction towards the lash stop surface.

Optionally, the valve assembly is such that for the second fluid pressure range, the valve assembly prevents fluid from flowing from the lash adjustment chamber. As such, for the second fluid pressure range, fluid cannot escape from the lash adjustment chamber as a consequence of which the lash adjustment piston is prevented from being moved in at least a direction towards the lash stop surface. Thereby, a zero or reduced lash may be ensured.

Optionally, the valve assembly is such that for the third fluid pressure range, the valve assembly allows fluid to flow from the lash adjustment chamber to the control fluid conduit. As such, for the third fluid pressure range, a pressure change, for instance a pressure increase, in the lash adjustment chamber due to a movement of the lash adjustment piston may be forwarded to the control fluid conduit thereby enabling that a pressure compensation in the lash adjustment chamber which in turn enables a movement of the lash adjustment piston.

Optionally, the valve assembly is such that for the third fluid pressure range, the valve assembly allows fluid to flow from the lash adjustment chamber to a drain channel but prevents fluid to flow from the control fluid conduit to the lash adjustment chamber.

Optionally, the valve assembly comprises a check valve and a spool. The spool has a spool inlet opening and a spool outlet opening. The check valve is adapted to assume an open check valve position relative to the spool, in which the spool inlet opening is in fluid communication with the spool outlet opening, and a closed check valve position relative to the spool, in which the spool inlet opening is fluidly disconnected from the spool outlet opening.

The above-mentioned valve assembly implies that the previously discussed two conditions for the lash adjustment piston may be achieved in a straightforward manner.

Optionally, the check valve comprises a check valve member. The spool comprises a check valve member seat and a check valve biasing means adapted to bias the check valve member towards the check valve member seat.

Optionally, the rocker arm comprises a spool cavity with a spool cavity wall. The spool is accommodated in the spool cavity and being moveable relative to the spool cavity wall. The spool is adapted to assume a closed spool condition, in which fluid communication between the control fluid conduit and the lash adjustment chamber via the spool inlet opening and a spool outlet opening is prevented.

Optionally, when the spool assumes the closed spool condition, fluid is allowed to flow from the lash adjustment chamber to a drain channel.

Optionally, the rocker arm comprises a spool biasing assembly adapted to bias the spool towards the closed spool condition.

Optionally, the spool is adapted to assume the closed spool condition for the first fluid pressure range.

Optionally, the spool is adapted to assume a first open spool condition, in which fluid communication between the control fluid conduit and the lash adjustment chamber via the spool inlet opening and the spool outlet opening is enabled when the check valve assumes the open check valve position relative to the spool.

Optionally, when the spool assumes the first open spool condition, fluid is prevented from flowing from the lash adjustment chamber to a drain channel.

Optionally, the spool is adapted to assume the first open spool condition for the second fluid pressure range.

Optionally, the spool is adapted to assume a second open spool condition, in which fluid communication between the control fluid conduit and the lash adjustment chamber is allowed irrespective of the position of the check valve relative to the spool.

Optionally, the spool is adapted to assume the second open spool condition for the third fluid pressure range.

Optionally, when the spool assumes the second open spool condition, fluid may flow between the control fluid conduit and the lash adjustment chamber without passing through the spool.

Optionally, when the spool assumes the second open spool condition, fluid is allowed to flow from the lash adjustment chamber to a drain channel but fluid is prevented from flowing from the control fluid conduit to the lash adjustment chamber.

As second aspect of the present invention relates to an inlet rocker arm adapted to control at least one inlet valve for an internal combustion engine, the inlet rocker arm being according to the first aspect of the present invention.

As third aspect of the present invention relates to an exhaust rocker arm adapted to control at least one exhaust valve for an internal combustion engine, the exhaust rocker arm being according to the first aspect of the present invention.

As fourth aspect of the present invention relates to a rocker arm assembly for an internal combustion engine. The rocker arm assembly comprises an inlet rocker arm according to the second aspect of the present invention and an exhaust rocker arm according to the third aspect of the present invention. The control fluid conduit of the inlet rocker arm and the control fluid conduit of the exhaust rocker arm are in fluid communication with each other.

Optionally, the low second predetermined threshold pressure level associated with the exhaust rocker arm is higher than the low second predetermined threshold pressure level, preferably higher than the high second predetermined threshold pressure level, associated with the inlet rocker arm.

A zero or reduced lash for an inlet rocker arm, in order to achieve a modified valve lift profile, may for instance be desired during low speed and loads of the internal combustion engine. At such low loads, it may be difficult to produce high pressure levels of the fluid that is intended to be fed to the valve assembly of the inlet rocker arm. For instance a fluid pressure source, such as a pump that is powered by the internal combustion engine, may only be capable of producing relatively low fluid pressures when the internal combustion engine is operating at low speed and load. As such, it may be desired to arrange the valve assembly of the inlet rocker arm such that a zero or reduced lash condition can be assumed for relatively low pressure levels.

Optionally, the first predetermined threshold level associated with the exhaust rocker arm is equal to or greater than the high second predetermined threshold pressure level associated with the inlet rocker arm.

As fifth aspect of the present invention relates to an internal combustion engine comprising a rocker arm according to the first aspect of the present invention and/or an inlet rocker arm according to the second aspect of the present invention and/or an exhaust rocker arm according to the third aspect of the present invention and/or a rocker arm assembly according to the fourth aspect of the present invention.

As sixth aspect of the present invention relates to a vehicle comprising a rocker arm according to any one the first aspect of the present invention and/or an inlet rocker arm according to the second aspect of the present invention and/or an exhaust rocker arm according to the third aspect of the present invention and/or a rocker arm assembly according to the fourth aspect of the present invention and/or an internal combustion engine according to the fifth aspect of the present invention.

As seventh aspect of the present invention relates to a method for controlling a lash in a rocker arm for an internal combustion engine. The rocker arm comprises a cavity with a cavity wall at least partially accommodating a lash adjustment piston for hydraulic lash adjustment. The rocker arm further comprises a lash stop surface, at least a portion of the lash adjustment piston being adapted to abut the lash stop surface during at least one operating condition of the rocker arm. The cavity comprises a lash adjustment chamber at least partially delimited by the lash adjustment piston, the rocker arm further comprising a control fluid conduit and a valve assembly located between the lash adjustment chamber and the control fluid conduit, as seen in an intended direction of flow from the control fluid conduit to the lash adjustment chamber.

The method comprises:

feeding fluid at a first fluid pressure range to the control fluid conduit such that the fluid pressure in the control fluid conduit is equal to or lower than a first predetermined threshold pressure level, such that the lash adjustment piston can move relative to the cavity wall in at least a direction towards the lash stop surface;

feeding fluid at a second fluid pressure range to the control fluid conduit such the fluid pressure in the control fluid conduit is from and including a low second predetermined threshold pressure level to and including a high second predetermined threshold pressure level, the low second predetermined threshold pressure level being greater than the first predetermined threshold pressure level, such that the lash adjustment piston is prevented from moving relative to the cavity wall in at least a direction towards the lash stop surface, and feeding fluid at a third fluid pressure range to the control fluid conduit such that the fluid pressure in the control fluid conduit exceeds a third predetermined threshold level, the third predetermined threshold level being greater than the high second predetermined threshold pressure level, such that the lash adjustment piston can move relative to the cavity wall in at least a direction towards the lash stop surface.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

The invention will be described below for a vehicle in the form of a truck 10 such as the truck illustrated in FIG. 1. The truck 10 should be seen as an example of a vehicle which could comprise a rocker arm, an inlet rocker arm, an exhaust rocker arm, a rocker arm assembly and/or an internal combustion engine according to the present invention.

However, the present invention may be implemented in a plurality of different types of vehicles. Purely by way of example, the present invention could be implemented in a truck, a tractor, a car, a bus, a seagoing vessel such as a ship or a boat, a work machine such as a wheel loader or an articulated hauler, or any other type of construction equipment. Moreover, the present invention may be implemented in an internal combustion engine that need not be associated with any vehicle.

Figure 1:
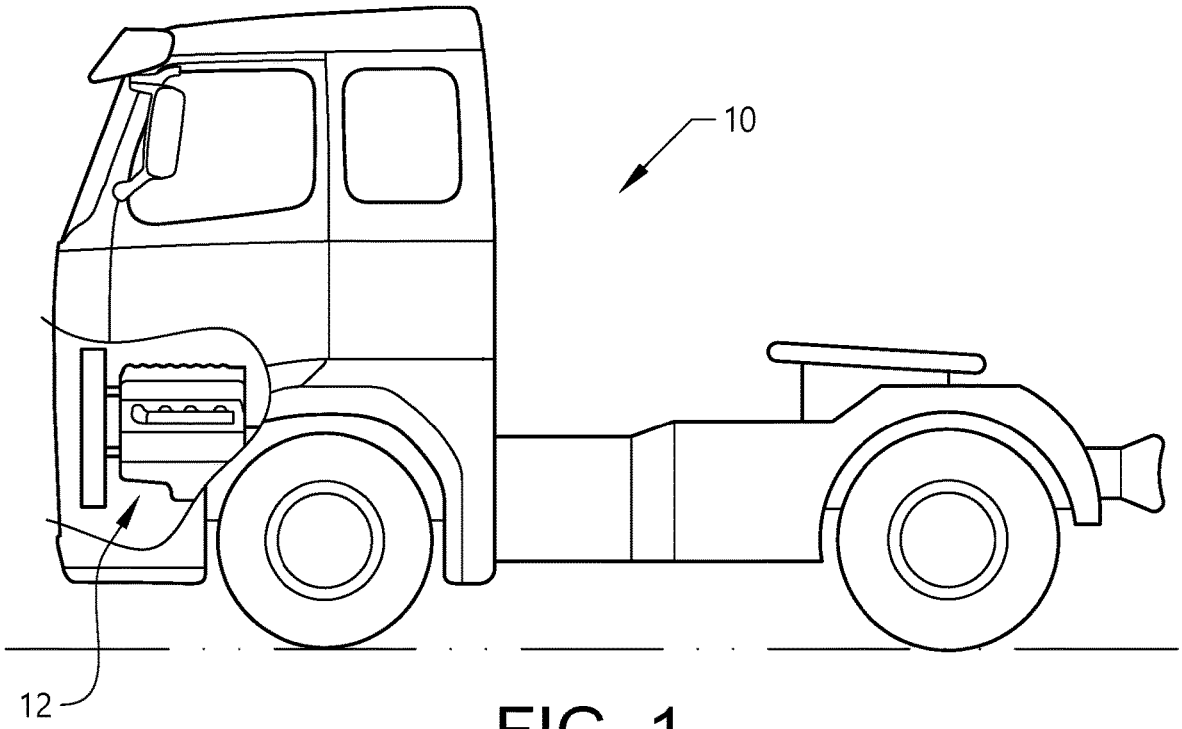
FIG. 1 illustrates a vehicle with an internal combustion engine.

The FIG. 1 vehicle 10 comprises an internal combustion engine 12.

Figure 2:
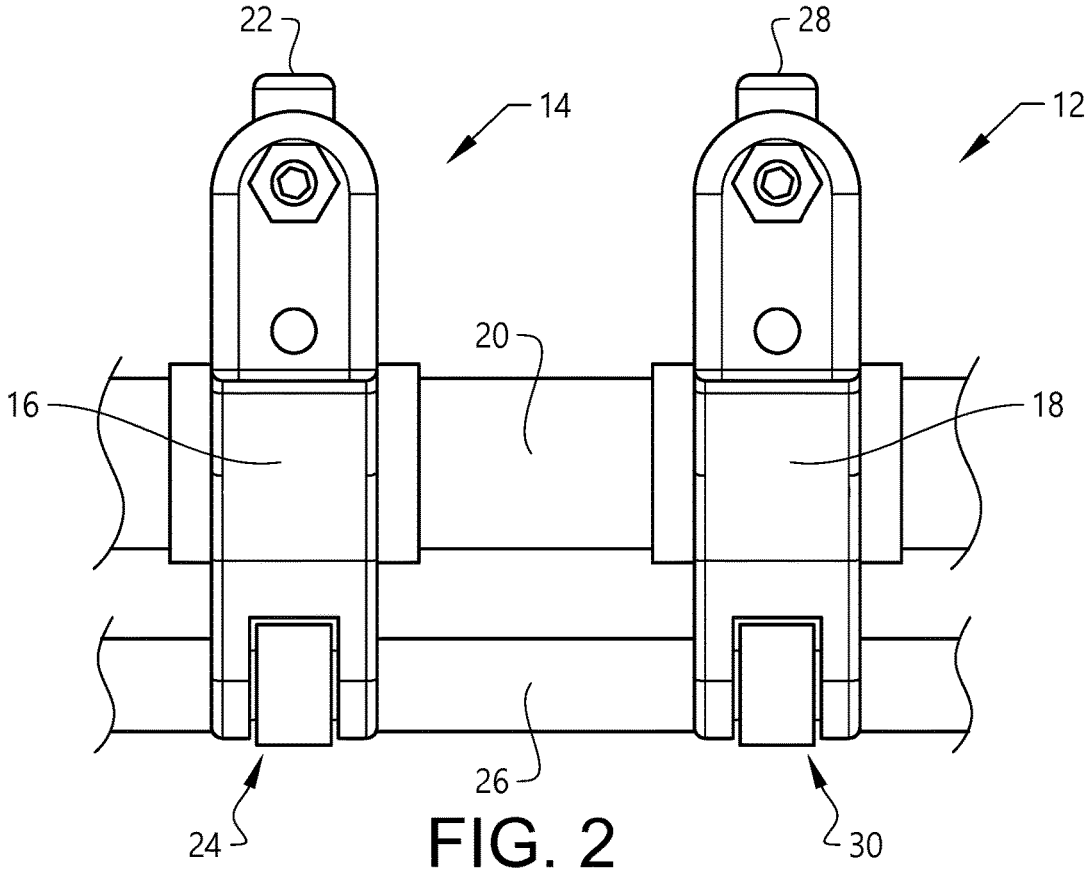
FIG. 2 is a top view of a portion of an internal combustion engine.

FIG. 2 is a top view of a portion of an internal combustion engine 12. In particular, FIG. 2 illustrates a portion of a rocker arm assembly 14 of an internal combustion engine 12. As may be gleaned from FIG. 2, the rocker arm assembly 14 comprises an inlet rocker arm 16 and an exhaust rocker arm 18. Each one of the inlet rocker arm 16 and the exhaust rocker arm 18 is pivotally connected to a common rocker arm shaft 20.

The inlet rocker arm 16 is on one side of the rocker arm shaft 20 provided with an inlet valve depressor 22, and on the other side an inlet rocker arm roller 24, which interacts with an inlet cam lobe (not shown) of a rotatable camshaft 26.

In a similar vein, the exhaust rocker arm 18 is on one side of the rocker arm shaft 20 provided with an exhaust valve depressor 28, and on the other side an exhaust rocker arm roller 30, which interacts with an exhaust cam lobe (not shown) of the rotatable camshaft 26.

In the embodiment illustrated in FIG. 2, the inlet rocker arm 16 and the exhaust rocker arm 18 are connected to a common rocker arm shaft 20 as well as to a common rotatable camshaft 26. However, it is also envisaged that embodiments of the internal combustion engine 12 may comprise separate rocker arm shaft, e.g. a first rocker arm shaft (not shown) to which the inlet rocker arm 16 is pivotally connected as well as a second rocker arm shaft (not shown) to which the exhaust rocker arm 18 is pivotally connected.

Moreover, it is contemplated that embodiments of the internal combustion engine 12 may comprise separate rotatable camshafts e.g. a first camshafts (not shown) interacting with the inlet rocker arm 16 is pivotally connected as well as a second camshafts (not shown) interacting with the exhaust rocker arm 18.

Figure 3:
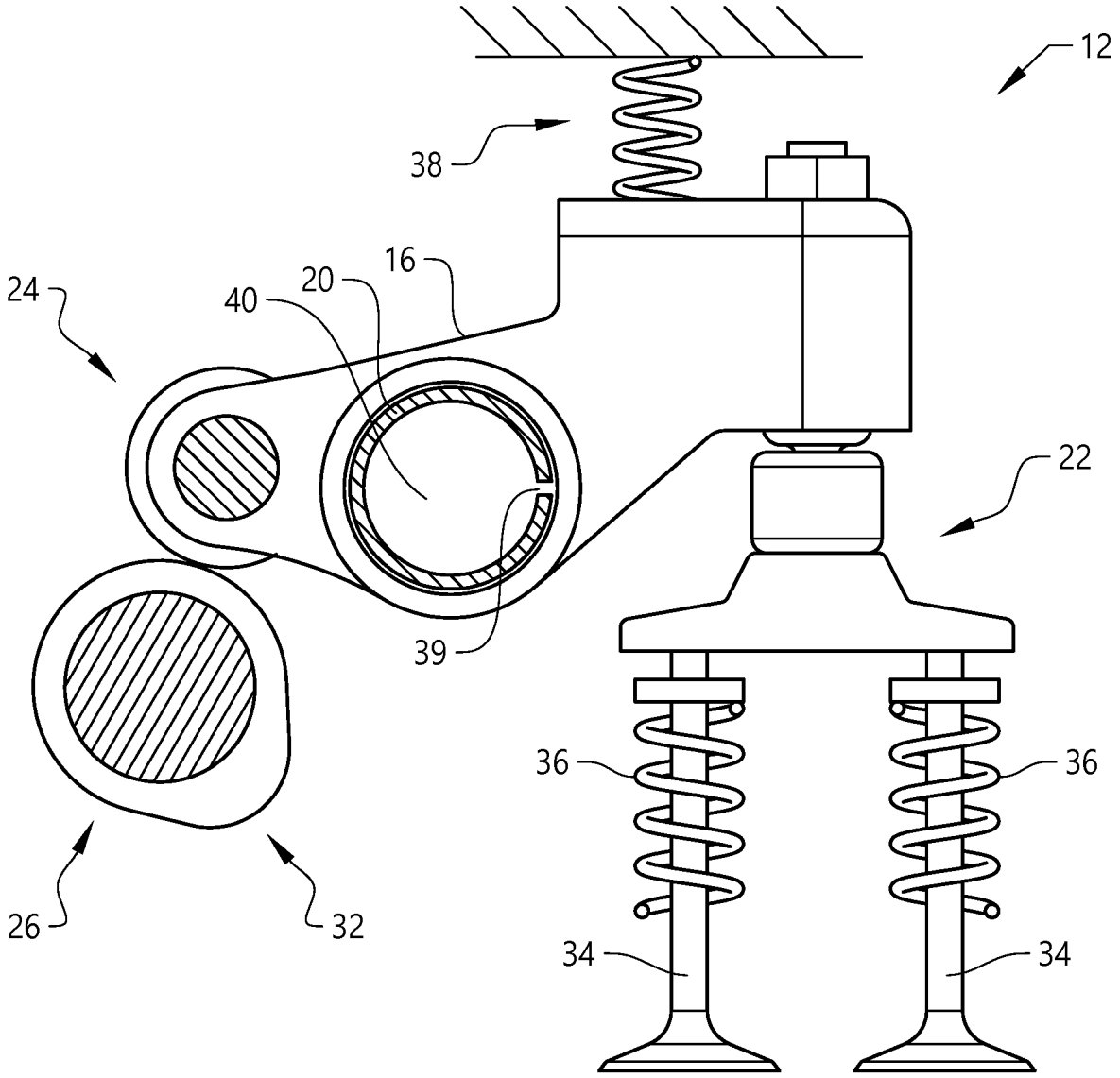
FIG. 3 is a side view of a rocker arm and engine components associated therewith.

FIG. 3 illustrates a side view of a rocker arm 16 and internal engine components associated therewith. The FIG. 3 rocker arm 16 corresponds to the inlet rocker arm 16 illustrated in FIG. 2. However, it is also contemplated that the FIG. 3 rocker arm could constitute the exhaust rocker arm 18 in the FIG. 2 internal combustion engine 12.

Moreover, FIG. 3 illustrates the previously discussed elements of the rocker arm assembly 14; the valve depressor 22 (which in the FIG. 3 embodiment is exemplified as a caliper) and the camshaft 26. Moreover, FIG. 3 illustrates that the camshaft 26 comprises a camshaft lobe 32 interacting with the rocker arm roller 24. Furthermore, FIG. 3 illustrates that valves 34 are connected to valve depressor 22. Additionally, though purely by way of example, each valve 34 may be associated with a biasing means 36 which in FIG. 3 is exemplified by a spring, such as a helical spring. Further, FIG. 3 illustrates that an optional rocker arm biasing means 38, which is exemplified by a spring in the FIG. 3 embodiment, biases the portion of the rocker arm located between the rocker arm shaft 20 and the valve depressor 22 in a direction towards the valve depressor 22. However, in other embodiments of the rocker arm assembly 14, the rocker arm biasing means 38 may be omitted.

In order to alter the displacement of the valves 34 as a function of the current position of the camshaft lobe 32, a lash of the rocker arm 16 may be adjusted. In the rocker arm 16 of the present invention, such a lash is hydraulically adjusted by adjusting the fluid pressure in a rocker arm shaft cavity 40 of the rocker arm shaft 20. FIG. 3 further illustrates that the rocker arm shaft cavity 40 is located within the rocker arm shaft 20. Moreover, as indicated in FIG. 3, the rocker arm shaft 20 comprises a rocker arm shaft conduit 39 providing a fluid communication between the rocker arm shaft cavity 40 and the environment ambient of the rocker arm shaft 20. Purely by way of example, and as indicated in FIG. 3, the rocker arm shaft conduit 39 may be at least partially radially extending. How such a hydraulic lash adjustment is achieved in presented hereinbelow.

Figure 4:
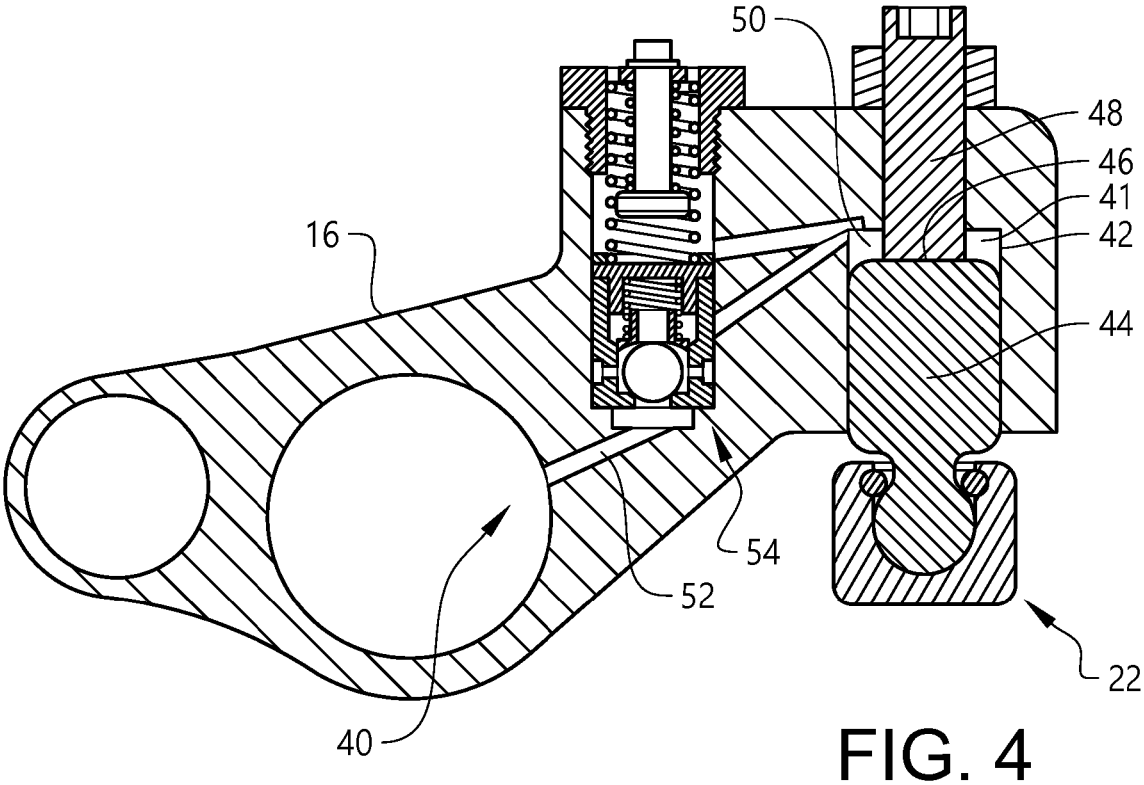
FIG. 4 is a cross-section side view of a first embodiment of a rocker arm according to the present invention.

To this end, reference is made to FIG. 4 illustrating a cross-sectional side view of a rocker arm 16 according to the present invention. As may be gleaned from FIG. 4, the rocker arm 16 comprises a cavity 41 with a cavity wall 42 at least partially accommodating a lash adjustment piston 44 for hydraulic lash adjustment. As may be gleaned from FIG. 4, the lash adjustment piston 44 is connected to the valve depressor 22 such that a displacement of the rocker arm 16 results in a displacement of the lash adjustment piston 44 which in turn results in a displacement of the valve depressor 22. The relation between the displacement of the rocker arm and the displacement of the valve depressor 22 may thus be controlled by the position of the lash adjustment piston 44 relative to the cavity wall 42.

The rocker arm further comprises a lash stop surface 46. At least a portion of the lash adjustment piston 44 is adapted to abut the lash stop surface 46 during at least one operating condition of the rocker arm 16. In the FIG. 4 embodiment, the lash stop surface 46 forms part of a lash stop member 48 that extends into the cavity 41 and which connected to the rocker arm 16 by means of threads (not shown) such that the lash stop member 48 may be rotated relative to the rocker arm 16 such that the position of the lash stop surface 46 relative to the cavity wall 42 may be altered to thereby change the position at which the lash adjustment piston 44 abuts the lash stop surface 46.

As such, if the lash adjustment piston 44 can move relative to the cavity wall 42 in at least a direction towards the lash stop surface 46, the lash adjustment piston 44 moves until it contacts the lash stop surface 46 before any displacement of the rocker arm 16 can be transferred to the valve depressor 22 via the lash adjustment piston 44. In other words, when the lash adjustment piston 44 can move relative to the cavity wall 42 in at least a direction towards the lash stop surface 46, a zero distance is obtainable between the lash adjustment piston 44 and the lash stop surface 46. On the other hand, if the lash adjustment piston 44 is prevented from moving relative to the cavity wall 42 in at least a direction towards the lash stop surface 46 a gap, i.e. a minimum distance between the adjustment piston 44 and the lash stop surface 46, is obtained which consequently will have an influence on the motion transfer from the rocker arm 16 to the valve depressor 22.

Further, the cavity 41 comprises a lash adjustment chamber 50 which is at least partially delimited by the lash adjustment piston 44. As such, depending on the position of the lash adjustment piston 44 relative to the cavity wall 42, the volume of the lash adjustment chamber 50 can be varied. Put differently, the cavity 41 may be an open cavity in the rocker arm 16. As a non-limiting example, the cavity 41 may be machined, e.g. drilled, in the rocker arm 16. When the lash adjustment piston 44 is at least partially inserted into the cavity 41, the lash adjustment chamber 50 is formed.

The rocker arm 16 further comprises a control fluid conduit 52 which can guide control fluid from a control fluid source (not shown in FIG. 4). Purely by way of example, and as is indicated in FIG. 4, the control fluid conduit 52 may preferably be in fluid communication, preferably constant fluid communication, with the rocker arm shaft cavity 40 presented hereinabove in relation to FIG. 3. Purely by way of example, the the control fluid conduit 52 may be in fluid communication with the rocker arm shaft cavity 40 via the rocker arm shaft conduit 39 presented hereinabove in relation to FIG. 3.

Moreover, the rocker arm 16 comprises a valve assembly 54 located between the lash adjustment chamber 50 and the control fluid conduit 52, as seen in an intended direction of flow from the control fluid conduit 52 to the lash adjustment chamber 50.

The valve assembly 54 is configured such that:

for a first fluid pressure range $\Delta P_1$ (see e.g. FIG. 5) wherein a fluid pressure in the control fluid conduit is equal to or lower than a first predetermined threshold pressure level $P_1$, the lash adjustment piston 44 can move relative to the cavity wall 42 in at least a direction towards the lash stop surface 46;

for a second fluid pressure range $\Delta P_2$ from and including a low second predetermined threshold pressure level $P_{L2}$ to and including a high second predetermined threshold pressure level $P_{H2}$, the low second predetermined threshold pressure level $P_{L2}$ being greater than the first predetermined threshold pressure level $P_1$, the lash adjustment piston 44 is prevented from moving relative to the cavity wall 42 in at least a direction towards the lash stop surface 46, and for a third fluid pressure range wherein the fluid pressure in the control fluid conduit exceeds a third predetermined threshold level $P_3$, the third predetermined threshold level $P_3$ being greater than the high second predetermined threshold pressure level $P_{H2}$, the lash adjustment piston 44 can move relative to the cavity wall 42 in at least a direction towards the lash stop surface 46.

Purely by way of example, and as will be elaborated on hereinbelow, the lash adjustment piston 44 may be prevented from moving relative to the cavity wall 42 in at least a direction towards the lash stop surface 46 by virtue of the fact that the fluid in the lash adjustment chamber 50 prevents the lash adjustment piston 44 from moving relative to the cavity wall 42 in at least a direction towards the lash stop surface 46.

Figure 5:
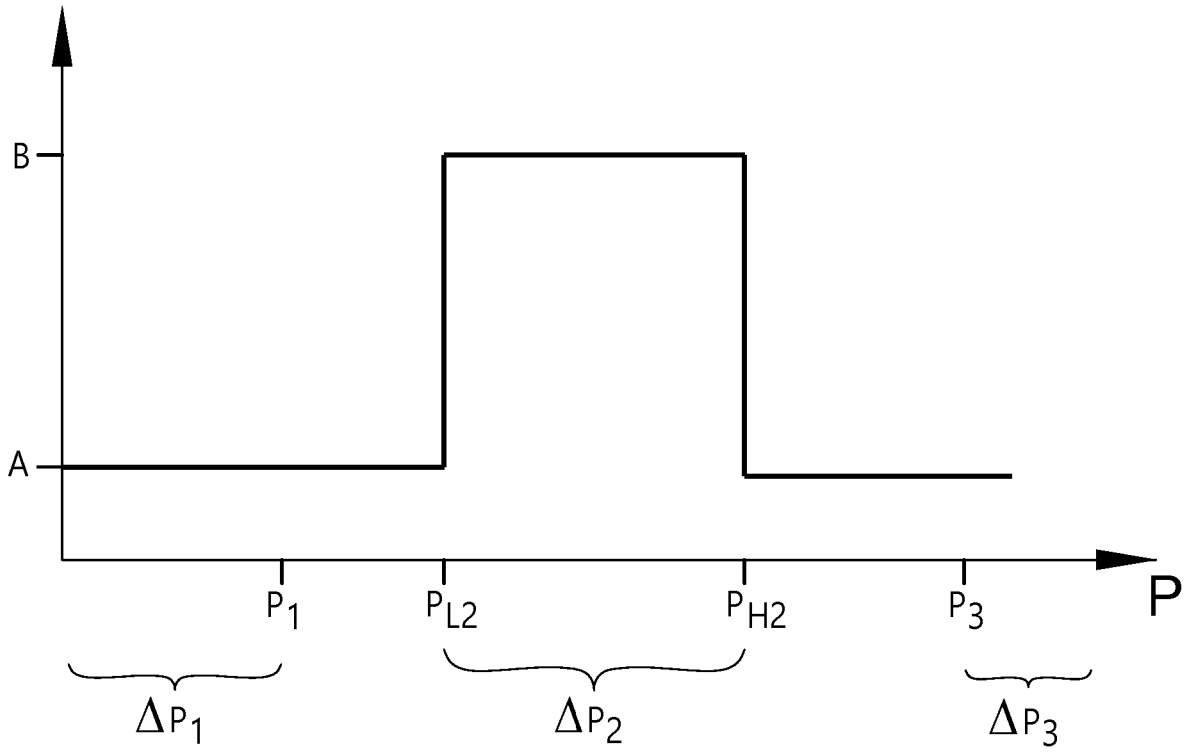
FIG. 5 is a graph illustrating the condition of a lash adjustment piston as a function of a pressure.

The above capacity of the valve assembly 54 is illustrated in FIG. 5 presenting a graph wherein pressure levels are schematically presented on the abscissa and the ordinate indicates different conditions of the lash adjustment piston 44. Here, the reference sign A on the ordinate indicates that the lash adjustment piston 44 can move relative to the cavity wall 42 in at least a direction towards the lash stop surface 46 and the reference sign B indicates that the lash adjustment piston 44 is prevented from moving relative to the cavity wall 42 in at least a direction towards the lash stop surface 46. As may be gleaned from FIG. 5, the valve assembly 54 is such that the lash adjustment piston 44 can move relative to the cavity wall 42 in at least a direction towards the lash stop surface 46 for low pressures as well as high pressures. FIG. 5 also illustrates that the lash adjustment piston 44 is prevented from moving relative to the cavity wall 42 in at least a direction towards the lash stop surface 46 for intermediate pressures, i.e. for pressures within the second fluid pressure range $\Delta P_2$. It should be noted that in implementations of the valve assembly 54, the pressure levels $P_1$, $P_{L2}$, $P_{H2}$, $P_3$ may be located closer to each other or more distant from each other than what is schematically indicated in FIG. 5.

Figure 6:
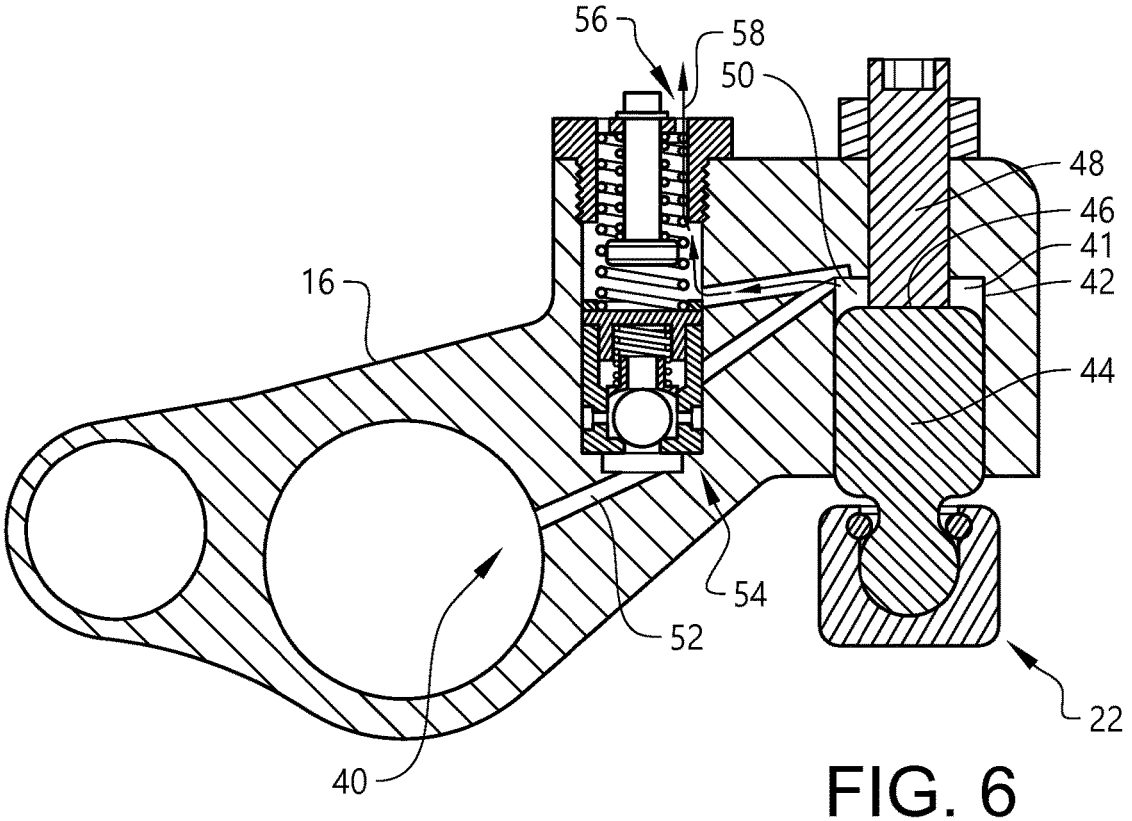
FIG. 6 is a cross-sectional side view of an embodiment of the rocker arm in a first condition.

The operability of the valve assembly 54 will be elaborated on hereinbelow, starting with FIG. 6.

As a first example, the valve assembly 54 is such that for the first fluid pressure range $\Delta P_1$, the valve assembly 54 prevents fluid to flow from the control fluid conduit 52 to the lash adjustment chamber 50. Instead, though purely by way of example, the valve assembly 54 may be such that for the first fluid pressure range $\Delta P_1$, the valve assembly 54 allows fluid to flow from the lash adjustment chamber 50 to a drain channel 56. As such, and as is indicated in FIG. 6, for the first fluid pressure range $\Delta P_1$, fluid may flow from the lash adjustment chamber 50 to a drain channel 56 along the path indicated by reference numeral 58. Thus, for the first fluid pressure range $\Delta P_1$, if the lash adjustment piston 44 is moved in the direction towards the lash stop surface 46, fluid may exit the lash adjustment chamber 50 via the drain channel 56 until the lash adjustment piston 44 abuts the lash stop surface 46.

Figure 7:
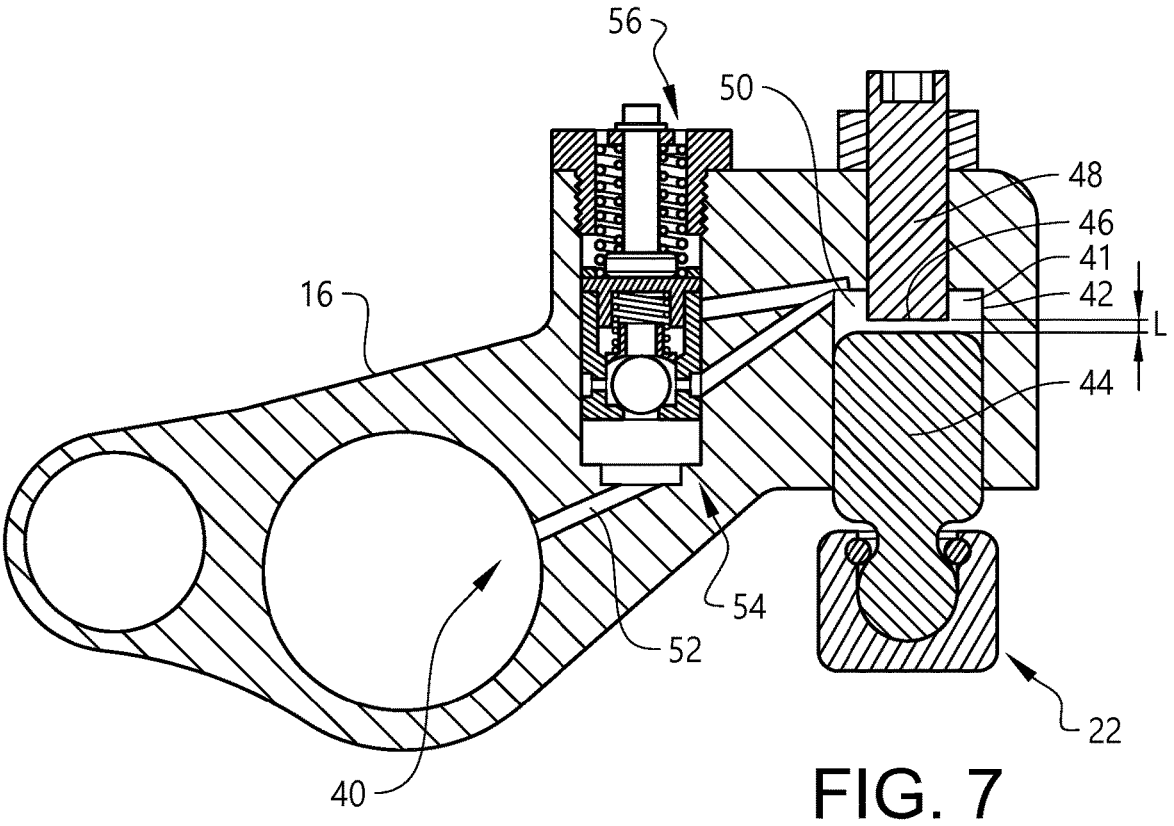
FIG. 7 is a cross-sectional side view of the FIG. 6 embodiment in a second condition.

Furthermore, with reference to FIG. 7, the valve assembly 54 may be such that for the second fluid pressure range $\Delta P_2$, the valve assembly 54 prevents fluid from flowing from the lash adjustment chamber 50. Thus, though purely by way of example, the valve assembly 54 may be such that for the second fluid pressure range $\Delta P_2$, the valve assembly 54 prevents fluid from flowing from the lash adjustment chamber 50 to either one of the control fluid conduit 52 and the drain channel 56.

As such, and as is indicated in FIG. 7, for the second fluid pressure range $\Delta P_2$, even if the lash adjustment piston 44 is imparted a force in a direction towards lash stop surface 46, the pressure in the fluid confined in the lash adjustment chamber 50 will impart a counteracting force on the lash adjustment piston 44 as a result of which the lash adjustment piston 44 will be prevented from moving relative to the cavity wall 42 in at least a direction towards the lash stop surface 46. Consequently, in the condition illustrated in FIG. 7, there will be a distance L between the lash adjustment piston 44 and the lash stop surface 46.

Figure 8:
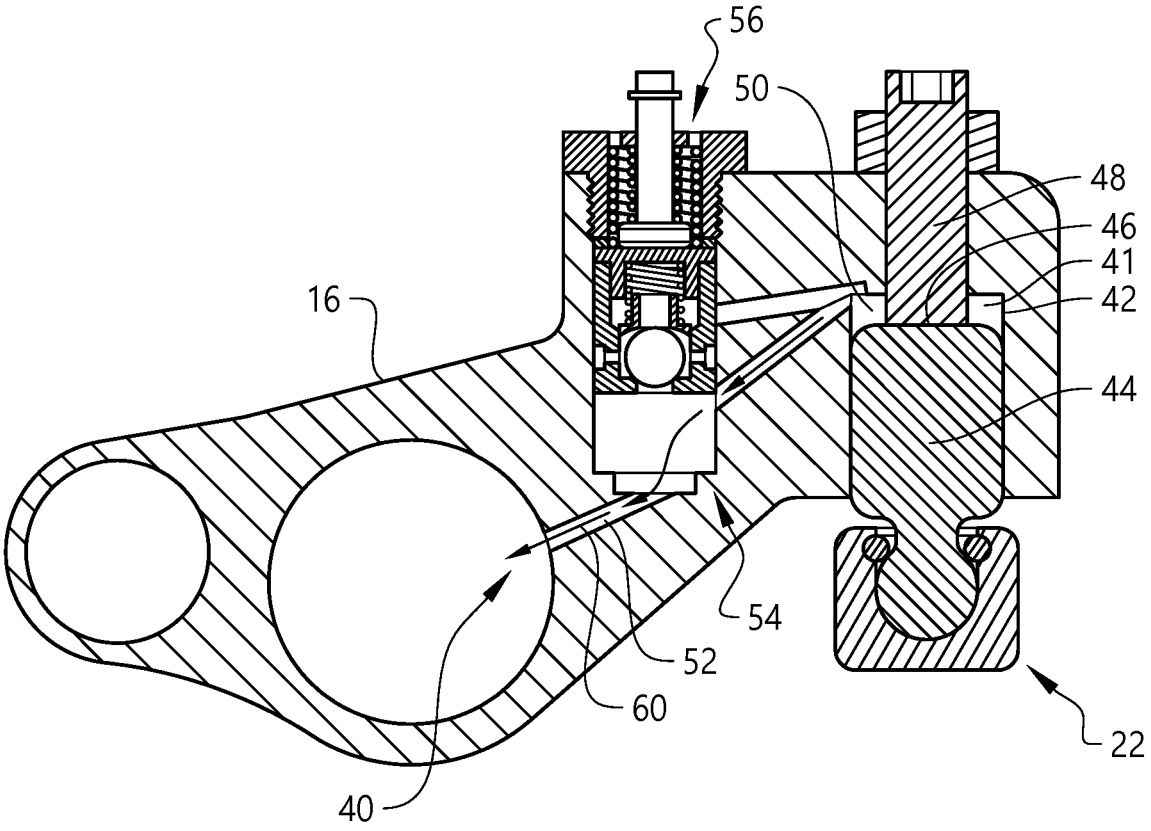
FIG. 8 is a cross-sectional side view of the FIG. 6 embodiment in a third condition.

Moreover, with reference to FIG. 8, the valve assembly 54 may be such that the third fluid pressure range $\Delta P_3$, the valve assembly 54 allows fluid to flow from the lash adjustment chamber 50 to the control fluid conduit 52. As such, and as is indicated in FIG. 8, for the third fluid pressure range $\Delta P_3$, fluid may flow from the lash adjustment chamber 50 to the control fluid conduit 52 along the path indicated by reference numeral 60. Thus, for the third fluid pressure range $\Delta P_3$, if the lash adjustment piston 44 is moved in the direction towards the lash stop surface 46, fluid may exit the lash adjustment chamber 50 to the control fluid conduit 52 until the lash adjustment piston 44 abuts the lash stop surface 46 such that a zero distance L is obtained.

It is also contemplated that, in embodiments of the rocker arm 16, the valve assembly 54 is such that for the third fluid pressure range $\Delta P_3$, the valve assembly 54 allows fluid to flow from the lash adjustment chamber 56 to a drain channel but prevents fluid to flow from the control fluid conduit 52 to the lash adjustment chamber 50. An example of such an embodiment will be presented hereinbelow with reference to FIG. 13.

Figure 9:
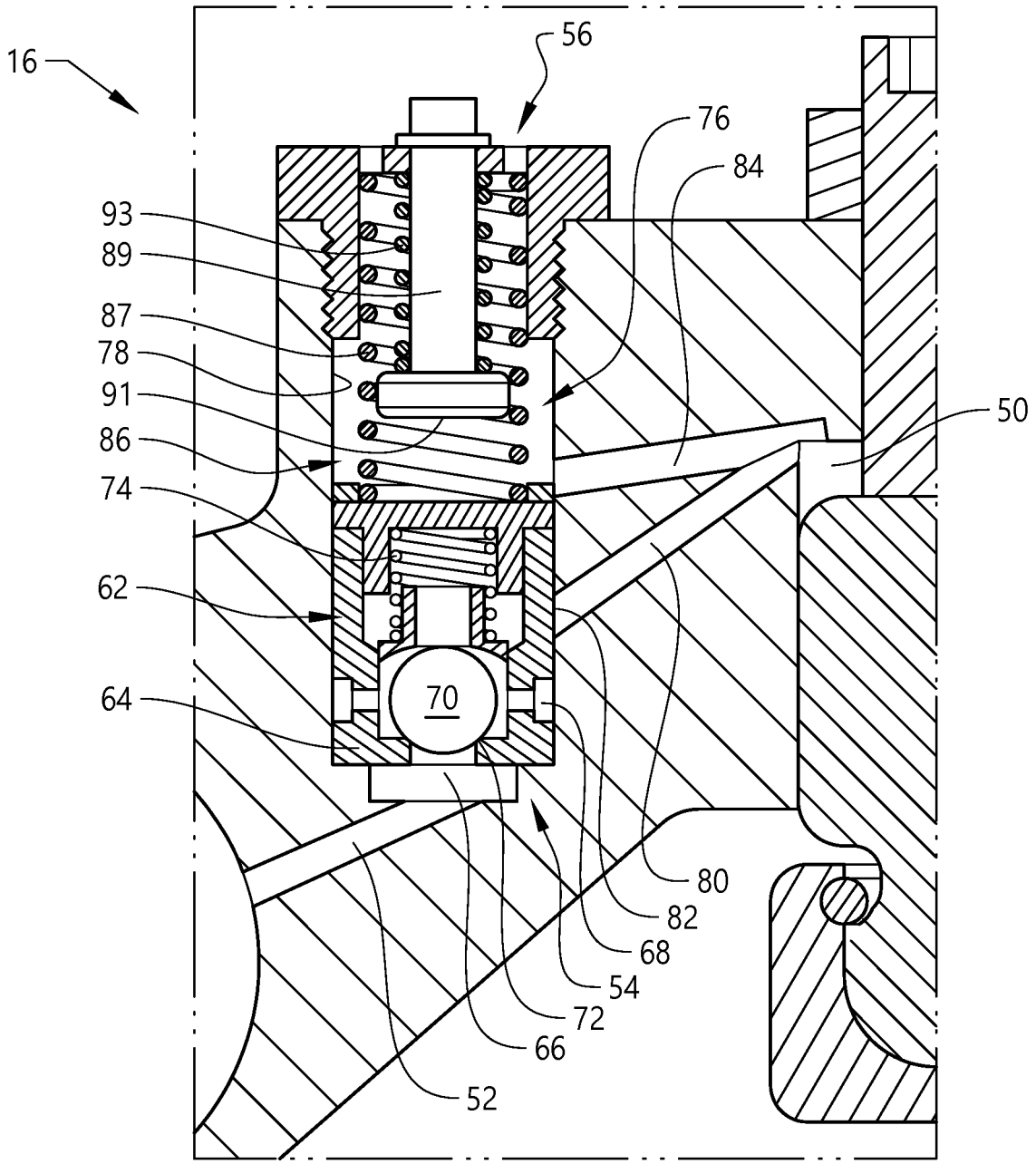
FIG. 9 is a cross-sectional side view of a portion of the FIG. 6 embodiment in the first condition.

FIG. 9 illustrates a preferred implementation of the valve assembly 54. As may be gleaned from FIG. 9, the valve assembly 54 comprises a check valve 62 and a spool 64. The spool 64 has a spool inlet opening 66 and a spool outlet opening 68. The check valve 62 is adapted to assume an open check valve position relative to the spool 64, in which the spool inlet opening 66 is in fluid communication with the spool outlet opening 68, and a closed check valve position relative to the spool 64, in which the spool inlet opening 66 is fluidly disconnected from the spool outlet opening 68.

Moreover, and as indicated in FIG. 9, the check valve 62 comprises a check valve member 70. The spool 64 comprises a check valve member seat 72 and a check valve biasing means 74 adapted to bias the check valve member 70 towards the check valve member seat 72. As such, in order for the check valve member 70 to be moved such that the check valve 62 assumes the open check valve position, the force applied on the check valve member 70 by the fluid at the spool inlet opening 66 must exceed the biasing force imparted by the check valve biasing means 74.

Moreover, as indicated in FIG. 9, the rocker arm 16 may comprise a spool cavity 76 with a spool cavity wall 78. The spool 64 is accommodated in the spool cavity 76 and is moveable relative to the spool cavity wall 78. The spool 64 is adapted to assume a closed spool condition, in which fluid communication between the control fluid conduit 52 and the lash adjustment chamber 50 via the spool inlet opening 66 and a spool outlet opening 68 is prevented. In the FIG. 9 embodiment, the spool cavity 76 is fluidly connected to the lash adjustment chamber 50 via a first lash adjustment chamber connection conduit 80. When the spool 64 assumes the closed spool condition, a side wall 82 of the spool 64 seals the first lash adjustment chamber connection conduit 80 to thereby prevent the above-mentioned fluid communication between the control fluid conduit 52 and the lash adjustment chamber 50.

Moreover, as further indicated in FIG. 9, the embodiment of the valve assembly 54 illustrated therein is such that when the spool 64 assumes the closed spool condition, fluid is allowed to flow from the lash adjustment chamber 50 to the drain channel 56. To this end, in the embodiment illustrated in FIG. 9, the spool cavity 76 is fluidly connected to the lash adjustment chamber 50 also via a second lash adjustment chamber connection conduit 84. Moreover, as indicated in FIG. 9, when the spool 64 assumes the closed spool condition, the spool 64 does not prevent fluid communication between the second lash adjustment chamber connection conduit 84 and the portion of the spool cavity 76 being located between the spool 64 and the drain channel 56 (i.e. the portion of the spool cavity 76 being located above the spool 64 in FIG. 9) when the spool 64 assumes its closed condition.

Furthermore, in the FIG. 9 embodiment, the rocker arm 16 comprises a spool biasing assembly 86 adapted to bias the spool 64 towards the closed spool condition.

In the FIG. 9 embodiment, the implementation of the spool biasing assembly 86 comprises a first biasing means 87, exemplified as a first spring in FIG. 9, located between the spool 64 and a portion of the rocker arm 16. Moreover, the FIG. 9 implementation of the spool biasing assembly 86 comprises a spool stop member 89 with a spool abutment surface 91, adapted to abut a portion of the spool 64. The spool stop member 89 is adapted to move relative to the spool cavity wall 78. Further, the spool biasing assembly 86 comprises a second biasing means 93, also exemplified as a spring, located between a portion of the spool stop member 91 and a portion of the rocker arm 16.

Purely by way of example, the spool 64 may be adapted to assume the closed spool condition for the first fluid pressure range $\Delta P_1$. As such, the biasing capacity of the spool biasing assembly 86 may be set such that the spool 64 does not move upwards in FIG. 9 for a force imparted on the spool 64 from the fluid in the control fluid conduit 52, assuming that the fluid pressure in the control fluid conduit 52 is within the first fluid pressure range $\Delta P_1$. As illustrated in FIG. 9, when the spool 64 is in the closed spool position, the first biasing means 87, but not the second biasing means 93, of the spool biasing assembly 86 imparts a biasing force on the spool 64.

Figure 10:
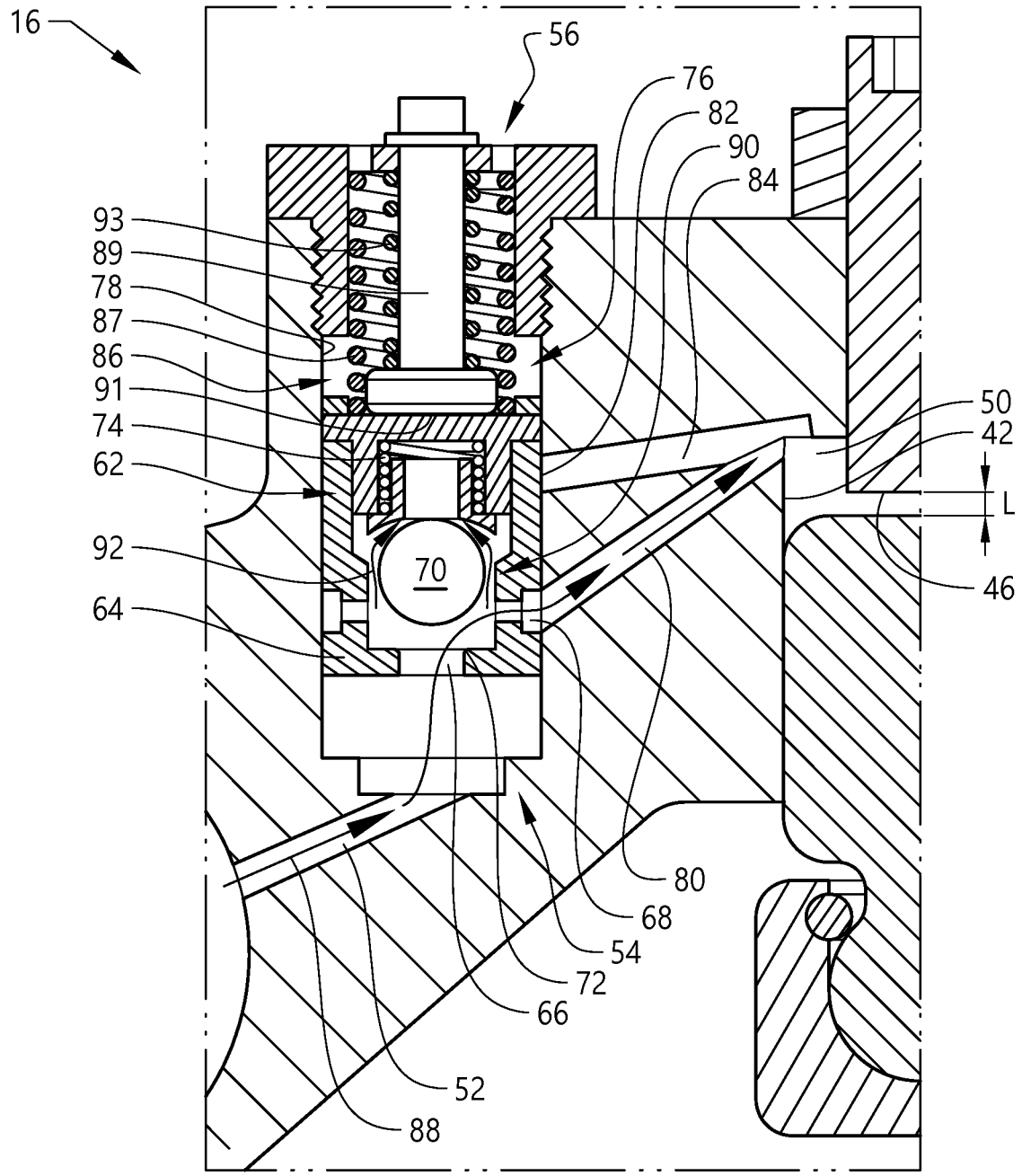
FIG. 10 is a cross-sectional side view of a portion of the FIG. 6 embodiment in an intermediate condition.

FIG. 10 illustrates that the spool 64 may be adapted to assume a first open spool condition, in which fluid communication between the control fluid conduit 52 and the lash adjustment chamber 50 via the spool inlet opening 66 and the spool outlet opening 68 is enabled when the check valve 62 assumes the open check valve position relative to the spool 64. As may be gleaned from FIG. 10, when the spool 64 assumes the first open spool condition, the spool outlet opening 68 may be in fluid communication with the first lash adjustment chamber connection conduit 80.

Moreover, as indicated in FIG. 10, when the spool 64 assumes the first open spool condition, fluid may be prevented from flowing from the lash adjustment chamber 50 to the drain channel 56. In the FIG. 10 embodiment, such prevention is achieved by virtue of the fact that the side wall 82 of the spool 64 seals the second lash adjustment chamber connection conduit 84 to thereby prevent the above-mentioned fluid communication between the lash adjustment chamber 50 and the drain channel 56.

Purely by way of example, the spool 64 may be adapted to assume the first open spool condition for the second fluid pressure range $\Delta P_2$. As such, the biasing capacity of the spool biasing assembly 86 may be set such that the spool 64 moves from the FIG. 9 position to the FIG. 10 position when a force is imparted on the spool 64 from the fluid in the control fluid conduit 52, assuming that the fluid pressure in the control fluid conduit 52 is within the second fluid pressure range $\Delta P_2$.

In particular, and as illustrated in FIG. 10, when the spool 64 assumes the first open spool condition, the spool abutment surface 91 of the spool stop member 89 abuts a portion of the spool 64. As such, if the spool 64 continues to move towards a second open spool condition, i.e. upwards from the FIG. 10 position, the first biasing means 87 as well as the second biasing means 93 of the spool biasing assembly 86 will impart a force on the spool 64. Put differently, when the spool 64 is in the first open spool position, the biasing capacity, e.g. the stiffness, of the spool biasing assembly 86 will increase as compared to the biasing capacity at e.g. the closed spool position.

Moreover, when the spool 64 assumes the first open spool condition and the check valve 62 assumes the open check valve position, such conditions are illustrated in FIG. 10, the control fluid conduit 52 is in fluid communication with the first lash adjustment chamber connection conduit 80 such that fluid may be transported from the control fluid conduit 52 to the first lash adjustment chamber connection conduit 80 and subsequently to the lash adjustment chamber 50. Such a fluid transport is indicated by line 88 in FIG. 10.

As such, when the spool 64 and the check valve 62 assumes the positions indicated in FIG. 10, the fluid pressure in the lash adjustment chamber 50 may increase as a result of which the lash adjustment piston 44 moves relative to the cavity wall 42 in a direction away from the lash stop surface 46 such that a non-zero distance L is obtained.

Purely by way of example, the magnitude of the fixed non-zero distance L may be within the range of 0.5-2 mm. Moreover, the magnitude of the fixed non-zero distance L may be associated with the specific rocker arm 16. As such, during operation of a rocker arm 16 in the FIG. 10 condition, as the volume of the lash adjustment chamber 50 increases, the lash adjustment piston 44 moves is a direction away from the lash stop surface 46 until a zero lash is obtained from the camshaft 26 to the valves 34 (see FIG. 3), thus setting the non-zero distance L.

Furthermore, as illustrated in FIG. 10, the check valve member 70 is arranged in the spool 64 such that a fluid passage 90 is provided past the check valve member 70 when the check valve 62 assumes the open check valve position. In the embodiment illustrated in FIG. 10, the fluid passage 90 is achieved by arranging a radial gap between the check valve member 70 and the spool 64. However, it is also envisaged that the fluid passage 90 may be implemented in alternative ways, e.g. by arranging a fluid passage conduit (not shown) in the spool 64.

Irrespective of the implementation of the fluid passage 90, the purpose of the fluid passage 90 is to guide fluid past the check valve member 70 such that the total fluid pressure acting on the valve member 70 imparts a relatively small load thereon. As such, when fluid has been guided past the check valve member 70, the check valve biasing means 74 will move the check valve member 70 such that the closed check valve position is obtained. The fluid flow past the check valve member 70 is indicated by lines 92 in FIG. 10.

Thus, when the check valve 62 is in the closed check valve position and a pressure is applied to the check valve member 70 which imparts a force thereon exceeding the counterforce generated by the check valve biasing means 74, the check valve member 70 moves such that the check valve 62 assumes the open check valve position. The open check valve position is maintained until a sufficiently large fluid pressure has been built up on the side of the check valve member 70 opposite to the side facing the check valve member seat 72. When a sufficiently large pressure has been assumed, the check valve biasing means 74 urges the check valve member 70 towards the check valve member seat 72 such that the check valve 62 again assumes the closed check valve position. Such a condition is illustrates in FIG. 11. Thus, in the FIG. 11 condition, a fixed non-zero distance L is obtained and maintained by virtue of the fact that fluid cannot enter or escape the lash adjustment chamber 50 in the thus illustrated condition.

Figure 11:
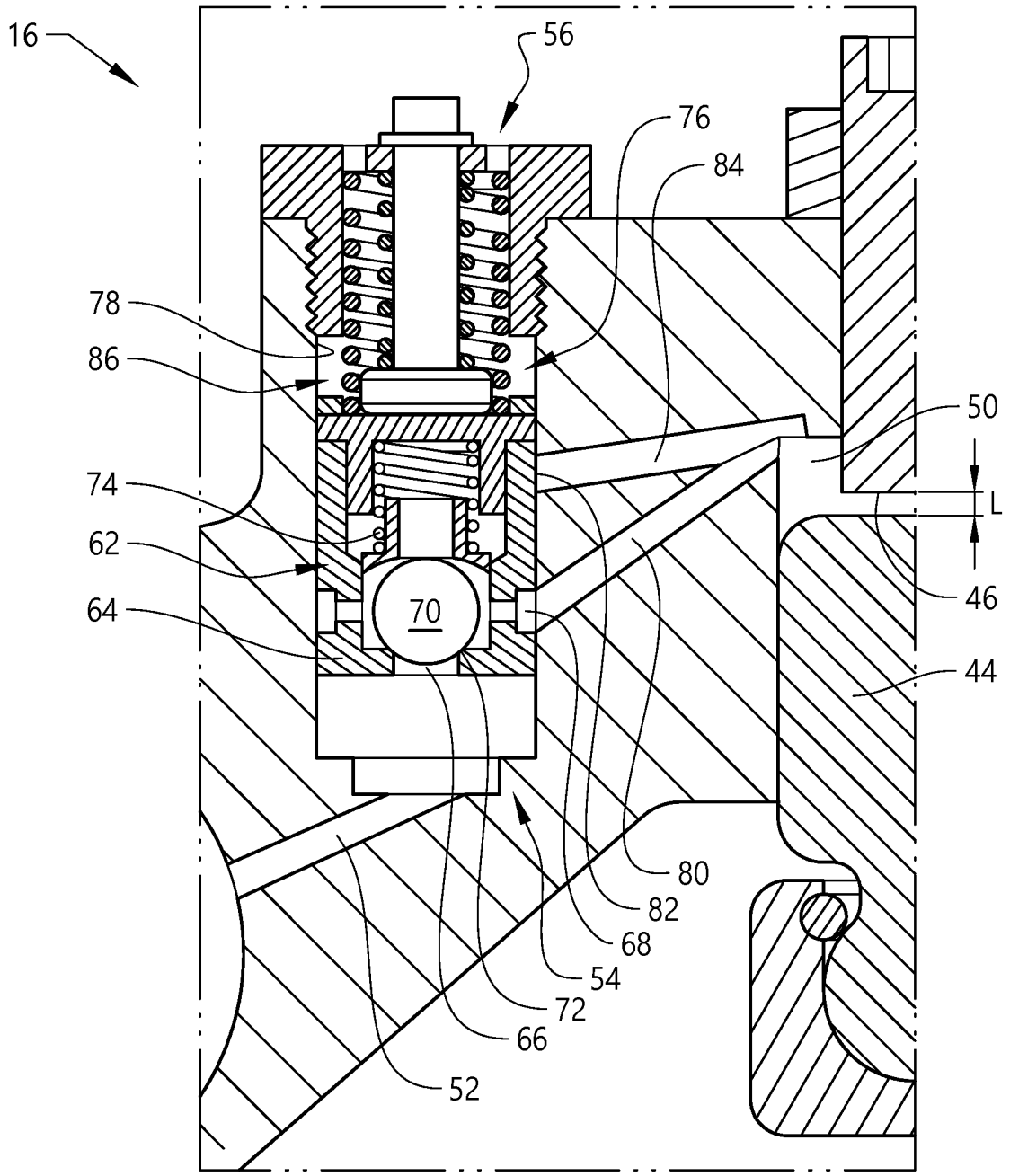
FIG. 11 is a cross-sectional side view of a portion of the FIG. 6 embodiment in the second condition.

As such, in the condition presented in FIG. 11, fluid is prevented from entering the lash adjustment chamber 50, since the check valve 62 is in the closed check valve position thus preventing fluid to be fed from the control fluid conduit 52 to the lash adjustment chamber 50. Moreover, in the condition presented in FIG. 11, fluid is prevented to be guided from the lash adjustment chamber 50 to the control fluid conduit 52, again owing to the fact that the check valve 62 is in the closed check valve position. Moreover, fluid is in the FIG. 11 condition prevented from being guided from the lash adjustment chamber 50 to the drain channel 56 since the side wall 82 of the spool 64 seals the second lash adjustment chamber connection conduit 84.

Figure 12:
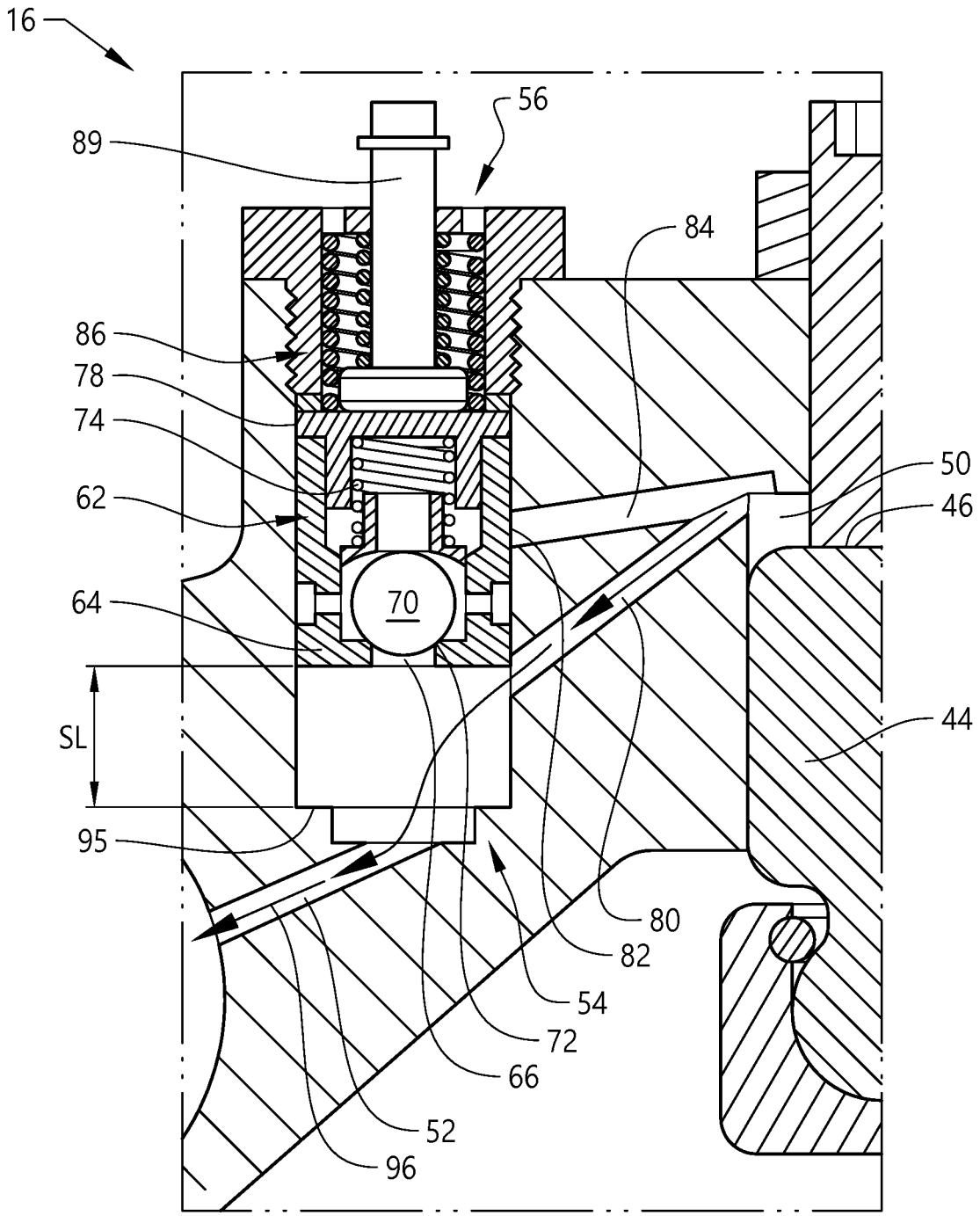
FIG. 12 is a cross-sectional side view of a portion of the FIG. 6 embodiment in the third condition.

FIG. 12 illustrates the rocker arm when the spool 64 assumes a second open spool condition, in which fluid communication between the control fluid conduit 52 and the lash adjustment chamber 50 is allowed irrespective of the position of the check valve 62 relative to the spool 64. In the embodiment illustrated in FIG. 12, the second open spool condition is a condition in which fluid can be transferred between the control fluid conduit 52 and the lash adjustment chamber 50 without passing through the spool 64. Purely by way of example, the spool 64 may be adapted to assume the second open spool condition for the third fluid pressure range $\Delta P_3$.

As such, when the spool 64 assumes the second open spool condition illustrated in FIG. 12 for instance, if the lash adjustment piston 44 moves relative to the cavity wall 42 in a direction in a direction towards the lash stop surface 46, there will be a fluid pressure increase in the lash adjustment chamber 50. Such a pressure increase will be forwarded to the control fluid conduit 52—such a fluid transport is indicated by lines 96 in FIG. 12—and the pressure increase will be levelled out which it turn results in that the lash adjustment piston 44 will be allowed to move relative to the cavity wall 42 in a direction towards the lash stop surface 46 until the lash adjustment piston 44 abuts the lash stop surface 46, i.e. until a zero distance L is obtained.

Moreover, as illustrated in FIG. 12, when the spool 64 assumes the second open spool condition, the spool stop member 89 has been displaced upwards in FIG. 12. Moreover, when the spool 64 assumes the second open position, a portion of the spool 64 abuts a portion of the rocker arm 16 such that the spool 64 cannot be displaced further. In other words, when the spool 64 is in the second open spool condition, the distance SL between a spool bottom stop surface 95 of the rocker arm 16 and the spool 64 is as large as it can get.

Figure 13:
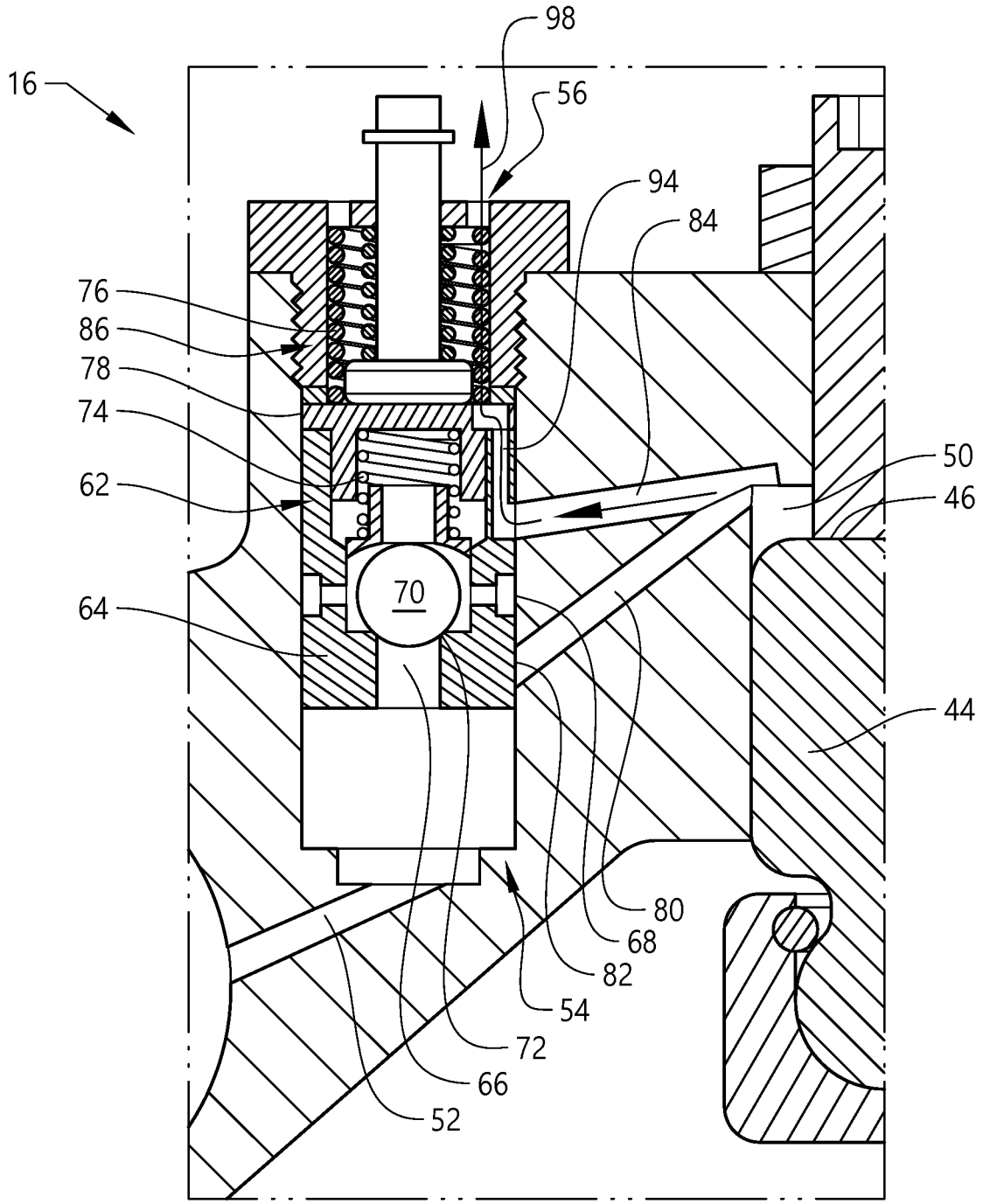
FIG. 13 is a cross-sectional side view of a portion of another embodiment of the rocker arm in the third condition.

FIG. 13 illustrates another embodiment of the rocker arm 16 with an implementation of the spool 64 being different from the FIG. 12 spool implementation. When the FIG. 13 implementation of the spool 64 assumes the second open spool condition, fluid is allowed to flow from the lash adjustment chamber 50 to the drain channel 56. Moreover, in the FIG. 13 implementation, fluid is prevented from flowing between the control fluid conduit 52 and the lash adjustment chamber 50.

To this end, the FIG. 13 implementation of the spool 64 comprises a drain guiding conduit 94 that provides a fluid communication between the second lash adjustment chamber connection conduit 84 and the drain channel 56 when the spool 64 assumes the second open spool condition. In the example and condition illustrated in FIG. 13, the drain guiding conduit 94 of the spool 64 enables fluid communication between the second lash adjustment chamber connection conduit 84 and the portion of the spool cavity 76 being located between the spool 64 and the drain channel 56 (i.e. above the spool 64 in the FIG. 13 example) when the spool 64 assumes its second open spool condition and fluid may therefrom be guided to the drain channel 56. Such a fluid transport is indicated by lines 98 in FIG. 13.

Furthermore, in the FIG. 13 embodiment, the spool 64 is implemented such that a side wall 82 of the spool 64 seals the first lash adjustment chamber connection conduit 80 when the spool 64 assumes its second open spool condition to thereby prevent fluid communication between the control fluid conduit 52 and the lash adjustment chamber 50.

Figure 14:
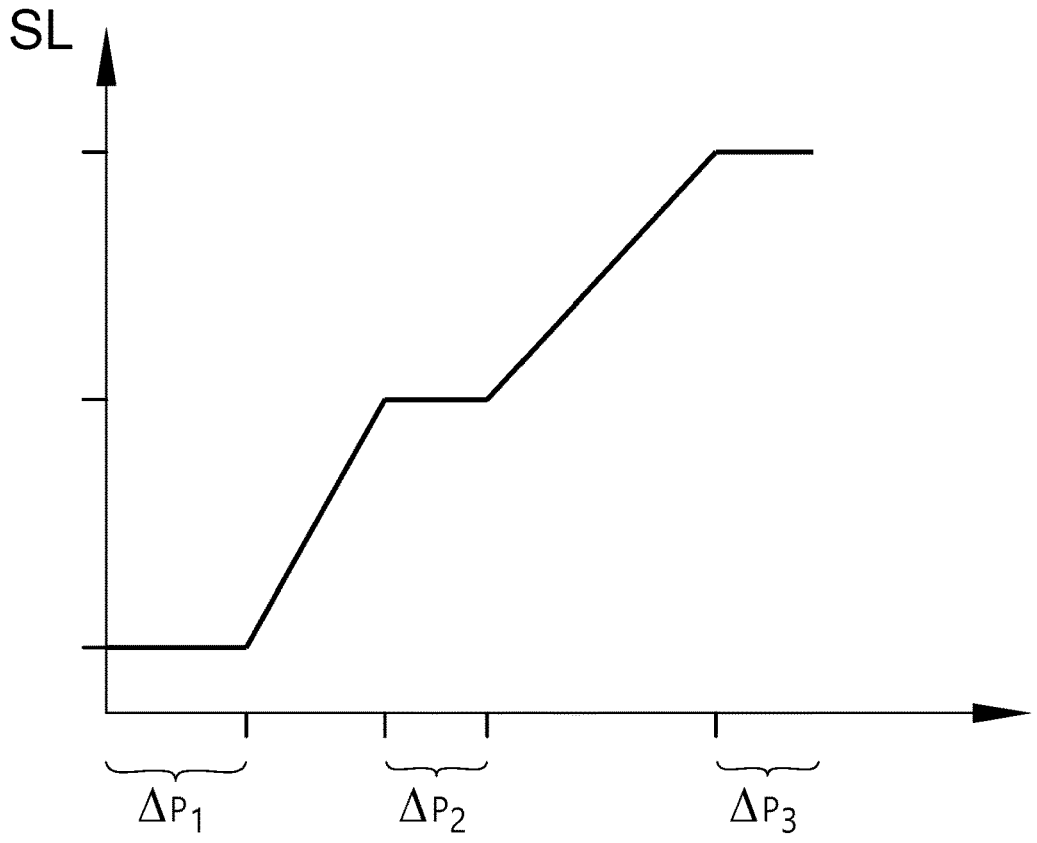
FIG. 14 is graph of the position of the spool as function of pressure.

FIG. 14 is a graph illustrating the position of the spool 64 relative to the spool cavity wall 78 as a function of the fluid pressure in the control fluid conduit 52, i.e. the distance SL from the bottom stop surface 95 of the rocker arm 16 to the spool 64. The FIG. 14 graph is applicable to the FIG. 9-12 implementation of the spool 64 as well as the FIG. 13 implementation of the spool 64.

As indicated in FIG. 14, when the fluid pressure in the control fluid conduit 52 is within the first fluid pressure range $\Delta P_1$, the spool 64 is in its bottommost position, i.e. the position illustrated in FIG. 9 for instance. Then, for pressures exceeding the first predetermined threshold pressure level $P_1$, the spool 64 moves towards its first open spool condition until the fluid pressure in the control fluid conduit 52 reaches the second fluid pressure range $\Delta P_2$. Throughout the second fluid pressure range $\Delta P_2$, the spool 64 remains stationary but when the pressure in the control fluid conduit 52 exceeds the high second predetermined threshold pressure level $P_{H2}$, the spool 64 moves towards the second open spool condition. Then, when the pressure in the control fluid conduit 52 reaches the third fluid pressure range $\Delta P_3$, the spool 64 assumes the second open spool condition.

As has been intimated hereinabove, when the spool 64 is located between the closed position and the first open position, only the first biasing means 87 imparts a basing force on the spool 64 whereas when the when the spool 64 is located between the first open position and the second open position, the first biasing means 87 as well as the second biasing means 93 of the spool biasing assembly 86 will impart a biasing force on the spool 64. Consequently, in FIG. 14, the slope of the curve between the first fluid pressure range $\Delta P_1$ and the second fluid pressure range $\Delta P_2$ is steeper that the slope of the curve between the second fluid pressure range $\Delta P_2$ and the third fluid pressure range $\Delta P_3$.

Purely by way of example, the rocker arm 16 described hereinabove may be an inlet rocker arm 16 or an outlet rocker arm 18.

Moreover, with reference back to FIG. 2, the present invention also relates to a rocker arm assembly 14 for an internal combustion engine. The rocker arm assembly 14 comprises an inlet rocker arm 16 and an exhaust rocker arm 18, each one of the inlet and exhaust rocker arms 16, 18 are in accordance with the present invention, for instance as presented hereinabove in relation to any one of FIG. 3 to FIG. 14. Purely by way of example, the control fluid conduit 52 of the inlet rocker arm 16 and the control fluid conduit 52 of the exhaust rocker arm 18 may be in fluid communication with each other. Moreover, the control fluid conduit 52 of the inlet rocker arm 16 and the control fluid conduit 52 of the exhaust rocker arm 18 may be connected to a common control fluid source (not shown).

Moreover, thought purely by way of example, the predetermined threshold pressure levels for the inlet rocker arm 16 may be different from the predetermined threshold pressure levels fort the exhaust rocker arm 18.

In particular, the second fluid pressure range $\Delta Pi_2$ associated with the inlet rocker arm 16 may be different from the second fluid pressure range $\Delta Pe_2$ associated with the exhaust rocker arm 18. Purely by way of example, the different pressure ranges may be obtained by having biasing capacities of the spool biasing assembly 86 associated with the inlet rocker arm 16 and the exhaust rocker arm 18 to differ, respectively.

The inlet rocker arm 16 and the exhaust rocker arm 18 may be connected to the same control fluid source (not shown) such that the condition of the respective lash adjustment piston, i.e. moveable or not in at least a direction towards the lash stop surface 46, may be controlled with the same fluid control signal.

Figure 15:
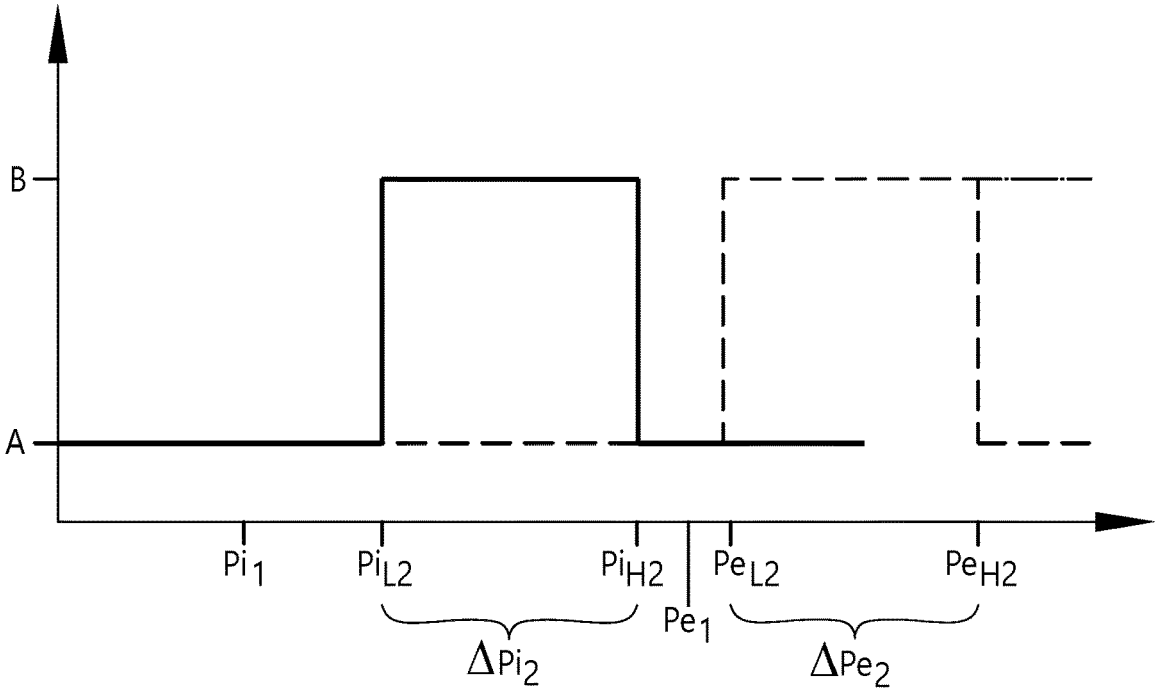
FIG. 15 is graph of illustrating the conditions of lash adjustment pistons for two different rocker arms as function of the pressure.

To this end, and with reference to FIG. 15, the condition of the respective lash adjustment piston of the inlet rocker arm 16 and the exhaust rocker arm 18, respectively, may be controlled by one and the same hydraulic pressure signal. However, the condition of the lash adjustment pistons need not be the same for a certain value of the hydraulic pressure signal.

To this end, reference is made to FIG. 15 presenting a graph wherein pressure levels are presented on the abscissa and the ordinate indicates different conditions of the lash adjustment piston 44 of the inlet rocker arm 16 as well as the lash adjustment piston 44 of the exhaust rocker arm 18. As for FIG. 5, the reference sign A on the ordinate indicates that the lash adjustment piston 44 can move relative to the cavity wall 42 in at least a direction towards the lash stop surface 46 and the reference sign B indicates that the lash adjustment piston 44 is prevented from moving relative to the cavity wall 42 in at least a direction towards the lash stop surface 46.

As may be gleaned from FIG. 15, the valve assembly 54 of the inlet rocker arm 16 may for instance be such that the lash adjustment piston 44 can move relative to the cavity wall 42 in at least a direction towards the lash stop surface 46 for low pressures as well as high pressures but wherein the lash adjustment piston 44 is prevented from moving relative to the cavity wall 42 in at least a direction towards the lash stop surface 46 for intermediate pressures, i.e. for pressures within the second fluid pressure range $\Delta Pi_2$ associated with the inlet rocker arm 16.

In a similar very, FIG. 15 illustrates that the valve assembly 54 of the exhaust rocker arm 18 is such that the lash adjustment piston 44 can move relative to the cavity wall 42 in at least a direction towards the lash stop surface 46 for low pressures as well as high pressures but that the lash adjustment piston 44 is prevented from moving relative to the cavity wall 42 in at least a direction towards the lash stop surface 46 for intermediate pressures, i.e. for pressures within the second fluid pressure range $\Delta Pe_2$ associated with the exhaust rocker arm 18.

Moreover, and as indicated in FIG. 15, the second fluid pressure range $\Delta Pi_2$ associated with the inlet rocker arm 16 need not be the same as the second fluid pressure range $\Delta Pe_2$ associated with the exhaust rocker arm 18.

Purely by way of example, the low second predetermined threshold pressure level $Pe_{L2}$ associated with the exhaust rocker arm 18 may be higher than the low second predetermined threshold pressure level $Pi_{L2}$, associated with the inlet rocker arm 16.

In fact, FIG. 15 illustrates a configuration in which the low second predetermined threshold pressure level $Pe_{L2}$ associated with the exhaust rocker arm 18 is higher than the high second predetermined threshold pressure level $Pi_{H2}$ associated with the inlet rocker arm 16.

However, it is also envisaged that in embodiments of the rocker arm assembly 14, the pressure levels for the exhaust rocker arm 18 may be lower than corresponding pressure levels for the inlet rocker arm 16. As a non-limiting example, in embodiments of the rocker arm assembly 14, the low second predetermined threshold pressure level $Pi_{L2}$ associated with the inlet rocker arm 16 may be higher than the low second predetermined threshold pressure level $Pe_{L2}$ associated with the exhaust rocker arm 18.

Furthermore, it is envisaged that in embodiments of the rocker arm assembly 14, the low second predetermined threshold pressure level $Pi_{L2}$ associated with the inlet rocker arm 16 may be higher than the high second predetermined threshold pressure level $Pe_{H2}$ associated with the exhaust rocker arm 18.

The conditions associated with the exhaust rocker arm 18 are illustrated by the dashed line in FIG. 15. As such, FIG. 15 illustrates that the exhaust rocker arm 18 may have conditions of the lash adjustment piston 44 that are similar to the conditions of the inlet rocker arm, viz that the that the lash adjustment piston 44 can move relative to the cavity wall 42 in at least a direction towards the lash stop surface 46 for low as well as high pressures and wherein the lash adjustment piston 44 is prevented from moving relative to the cavity wall 42 in at least a direction towards the lash stop surface 46 for a pressure range between the low and high pressures.

However, as indicated by the dashed and dotted line in FIG. 15, it is also envisaged that the embodiments of the exhaust rocker arm 18 may have another set of conditions as a function of the pressure. For instance, embodiments of the exhaust rocker arm 18 may have a condition set in which the lash adjustment piston 44 can move relative to the cavity wall 42 in at least a direction towards the lash stop surface 46 for low pressures and wherein the lash adjustment piston 44 is prevented from moving relative to the cavity wall 42 in at least a direction towards the lash stop surface 46 for pressures exceeding the low pressures. Put differently, embodiments of the exhaust rocker arm 18 are envisaged in which the lash adjustment piston 44 is not allowed to move relative to the cavity wall 42 in at least a direction towards the lash stop surface 46 for high pressures.

Moreover, and as is indicated in the FIG. 15 example, the first predetermined threshold level $Pe_1$ associated with the exhaust rocker arm 18 may be equal to or greater than the high second predetermined threshold pressure level $Pi_{H2}$ associated with the inlet rocker arm 16.

Figure 16:
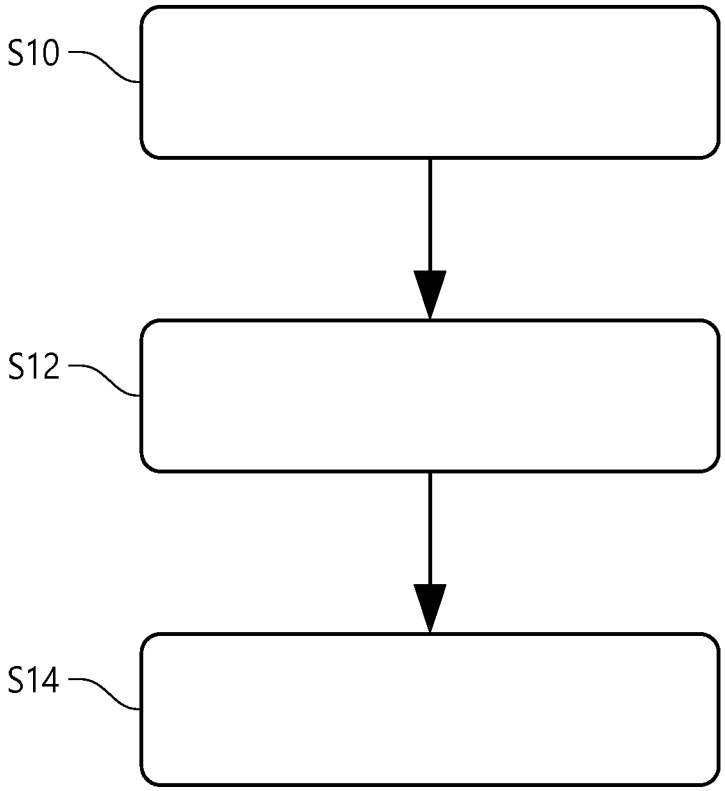
FIG. 16 is a flow chart illustrating an embodiment of a method according to the present invention.

Finally, FIG. 16 illustrates a flow chart for a method for controlling a lash L in a rocker arm 16 for an internal combustion engine 12. The rocker arm 16 comprises a cavity 41 with a cavity wall 42 at least partially accommodating a lash adjustment piston 44 for hydraulic lash adjustment. The rocker arm 16 further comprises a lash stop surface 46, at least a portion of the lash adjustment piston 44 being adapted to abut the lash stop surface 46 during at least one operating condition of the rocker arm 16. The cavity 41 comprises a lash adjustment chamber 50 at least partially delimited by the lash adjustment piston 44, the rocker arm 16 further comprises a control fluid conduit 52 and a valve assembly 54 located between the lash adjustment chamber 50 and the control fluid conduit 52, as seen in an intended direction of flow from the control fluid conduit 52 to the lash adjustment chamber 50.

The method comprises:

S10 feeding fluid at a first fluid pressure range $\Delta P_1$ to the control fluid conduit 52 such that the fluid pressure in the control fluid conduit 52 is equal to or lower than a first predetermined threshold pressure level $P_1$, such that the lash adjustment piston 44 can move relative to the cavity wall 42 in at least a direction towards the lash stop surface 46;

S12 feeding fluid at a second fluid pressure range $\Delta P_2$ to the control fluid conduit 52 such the fluid pressure in the control fluid conduit 52 is from and including a low second predetermined threshold pressure level $P_{L2}$ to and including a high second predetermined threshold pressure level $P_{H2}$, the low second predetermined threshold pressure level $P_{L2}$ being greater than the first predetermined threshold pressure level $P_1$, such that the lash adjustment piston 44 is prevented from moving relative to the cavity wall 42 in at least a direction towards the lash stop surface 46, and S14 feeding fluid at a third fluid pressure range $\Delta P_3$ to the control fluid conduit 52 such that the fluid pressure in the control fluid conduit 52 exceeds a third predetermined threshold level $P_3$, the third predetermined threshold level $P_3$ being greater than the high second predetermined threshold pressure level $P_{H2}$, such that the lash adjustment piston 44 can move relative to the cavity wall 42 in at least a direction towards the lash stop surface 46.

Purely by way of example, as regards feature S12 hereinabove, the lash adjustment piston 44 may be prevented from moving relative to the cavity wall 42 in at least a direction towards the lash stop surface 46 by virtue of the fact that the fluid in the lash adjustment chamber 50 prevents the lash adjustment piston 44 from moving relative to the cavity wall 42 in at least a direction towards the lash stop surface 46.

The method as presented hereinabove can for instance be carried out on any one of the above presented embodiments of the rocker arm 16.

It is to be understood that the present invention is not limited to the embodiments described above and illustrated in the drawings; rather, the skilled person will recognize that many changes and modifications may be made within the scope of the appended claims.

The invention claimed is:

1. A rocker arm (16) for an internal combustion engine (12), said rocker arm (16) comprising a cavity (41) with a cavity wall (42) at least partially accommodating a lash adjustment piston (44) for hydraulic lash adjustment, said rocker arm (16) further comprising a lash stop surface (46), at least a portion of said lash adjustment piston (44) being adapted to abut said lash stop surface (46) during at least one operating condition of said rocker arm (16), said cavity (41) comprising a lash adjustment chamber (50) at least partially delimited by said lash adjustment piston (44), said rocker arm (16) further comprising a control fluid conduit (52) and a valve assembly (54) located between said lash adjustment chamber (50) and said control fluid conduit (52), as seen in an intended direction of flow from said control fluid conduit (52) to said lash adjustment chamber (50), said valve assembly (54) being such that:

for a first fluid pressure range ($\Delta P_1$) wherein a fluid pressure in said control fluid conduit (52) is equal to or lower than a first predetermined threshold pressure level ($P_1$), said lash adjustment piston (44) can move relative to said cavity wall (42) in at least a direction towards said lash stop surface (46);

for a second fluid pressure range ($\Delta P_2$) from and including a low second predetermined threshold pressure level ($P_{L2}$) to and including a high second predetermined threshold pressure level ($P_{H2}$), said low second predetermined threshold pressure level ($P_{L2}$) being greater said first predetermined threshold pressure level ($P_1$), said lash adjustment piston (44) is prevented from moving relative to said cavity wall (42) in at least the direction towards said lash stop surface (46), and for a third fluid pressure range ($\Delta P_3$) wherein the fluid pressure in said control fluid conduit (52) exceeds a third predetermined threshold level ($P_3$), said third predetermined threshold level ($P_3$) being greater than said high second predetermined threshold pressure level ($P_{H2}$), said lash adjustment piston (44) can move relative to said cavity wall (42) in at least the direction towards said lash stop surface (46).

2. The rocker arm (16) according to claim 1, wherein said valve assembly (54) is such that:

for said first fluid pressure range ($\Delta P_1$), said valve assembly (54) prevents fluid to flow from said control fluid conduit (52) to said lash adjustment chamber (50).

3. The rocker arm (16) according to claim 1, wherein said valve assembly (54) is such that:

for said first fluid pressure range ($\Delta P_1$), said valve assembly (54) allows fluid to flow from said lash adjustment chamber (50) to a drain channel (56).

4. The rocker arm (16) according to claim 1, wherein said valve assembly (54) is such that:

for said second fluid pressure range ($\Delta P_2$), said valve assembly (54) prevents fluid from flowing from said lash adjustment chamber (50).

5. The rocker arm (16) according to claim 1, wherein said valve assembly (54) is such that:

for said third fluid pressure range ($\Delta P_3$), said valve assembly (54) allows fluid to flow from said lash adjustment chamber (50) to said control fluid conduit (52).

6. The rocker arm (16) according to claim 1, wherein said valve assembly (54) is such that:

for said third fluid pressure range ($\Delta P_3$), said valve assembly (54) allows fluid to flow from said lash adjustment chamber (50) to a drain channel (56) but prevents fluid to flow from said control fluid conduit (52) to said lash adjustment chamber (50).

7. The rocker arm (16) according to claim 1, wherein said valve assembly (54) comprises a check valve (62) and a spool (64), said spool (64) having a spool inlet opening (66) and a spool outlet opening (68), said check valve (62) being adapted to assume an open check valve position relative to said spool (64), in which said spool inlet opening (66) is in fluid communication with said spool outlet opening (68), and a closed check valve position relative to said spool (64), in which said spool inlet opening (66) is fluidly disconnected from said spool outlet opening (68).

8. The rocker arm (16) according to claim 7, wherein said check valve (62) comprises a check valve member (70), said spool (64) comprising a check valve member seat (72) and a check valve biasing means (74) adapted to bias said check valve member (70) towards said check valve member seat (72).

9. The rocker arm (16) according to claim 7, wherein said rocker arm (16) comprises a spool cavity (76) with a spool cavity wall (78), said spool (64) being accommodated in said spool cavity (76) and being moveable relative to said spool cavity wall (78), said spool (64) being adapted to assume a closed spool condition, in which fluid communication between said control fluid conduit (52) and said lash adjustment chamber (50) via said spool inlet opening (66) and the spool outlet opening (68) is prevented.

10. The rocker arm (16) according to claim 9, wherein when said spool (64) assumes said closed spool condition, fluid is allowed to flow from said lash adjustment chamber (50) to a drain channel (56).

11. The rocker arm (16) according to claim 9, wherein said rocker arm (16) comprises a spool biasing assembly (86) adapted to bias said spool towards said closed spool condition.

12. The rocker arm (16) according to claim 9, wherein said spool (64) is adapted to assume said closed spool condition for said first fluid pressure range ($\Delta P_1$).

13. The rocker arm (16) according to claim 9, wherein said spool (64) is adapted to assume a first open spool condition, in which fluid communication between said control fluid conduit (52) and said lash adjustment chamber (50) via said spool inlet opening (66) and said spool outlet opening (68) is enabled when said check valve (62) assumes said open check valve position relative to said spool (64).

14. The rocker arm (16) according to claim 13, wherein when said spool (64) assumes said first open spool condition, fluid is prevented from flowing from said lash adjustment chamber (50) to a drain channel (56).

15. The rocker arm (16) according to claim 13, wherein said spool (64) is adapted to assume said first open spool condition for said second fluid pressure range ($\Delta P_2$).

16. The rocker arm (16) according to claim 13, wherein said spool (64) is adapted to assume a second open spool condition, in which fluid communication between said control fluid conduit (52) and said lash adjustment chamber (50) is allowed irrespective of a position of the check valve (62) relative to said spool (64).

17. The rocker arm (16) according to claim 16, wherein said spool (64) is adapted to assume said second open spool condition for said third fluid pressure range ($\Delta P_3$).

18. The rocker arm (16) according to claim 16, wherein when said spool (64) assumes said second open spool condition, fluid may flow between said control fluid conduit (52) and said lash adjustment chamber (50) without passing through said spool (64).

19. The rocker arm (16) according to claim 16, wherein when said spool (64) assumes said second open spool condition, fluid is allowed to flow from said lash adjustment chamber (50) to a drain channel (56) but fluid is prevented from flowing from said control fluid conduit (52) to said lash adjustment chamber (50).

20. An inlet rocker arm (16) adapted to control at least one inlet valve for an internal combustion engine (12), said inlet rocker arm (16) being according to claim 1.

21. A rocker arm assembly (14) for an internal combustion engine (12), said rocker arm assembly (14) comprising an inlet rocker arm (16) according to claim 20 and an exhaust rocker arm (16), the control fluid conduit (52) of said inlet rocker arm (16) and the control fluid conduit (52) of said exhaust rocker arm (18) being in fluid communication with each other.

22. The rocker arm assembly (14) according to claim 21, wherein said low second predetermined threshold pressure level ($Pe_{L2}$) associated with said exhaust rocker arm (18) is higher than said low second predetermined threshold pressure level (PiL2), higher than said high second predetermined threshold pressure level ($Pi_{H2}$), associated with said inlet rocker arm (16).

23. The rocker arm assembly (14) according to claim 22, wherein said first predetermined threshold level ($Pe_1$) associated with said exhaust rocker arm (18) is equal to or greater than said high second predetermined threshold pressure level ($Pi_{H2}$) associated with said inlet rocker arm (16).

24. An exhaust rocker arm (18) adapted to control at least one exhaust valve for an internal combustion engine (12), said exhaust rocker arm (18) being according to claim 1.

25. An internal combustion engine (12) comprising a rocker arm (16) according to claim 1.

26. A vehicle (10) comprising a rocker arm (16) according to claim 1.

27. A method for controlling a lash in a rocker arm for an internal combustion engine (12), said rocker arm comprising a cavity (41) with a cavity wall (42) at least partially accommodating a lash adjustment piston (44) for hydraulic lash adjustment, said rocker arm further comprising a lash stop surface (46), at least a portion of said lash adjustment piston (44) being adapted to abut said lash stop surface (46) during at least one operating condition of said rocker arm, said cavity (41) comprising a lash adjustment chamber (50) at least partially delimited by said lash adjustment piston (44), said rocker arm further comprising a control fluid conduit (52) and a valve assembly (54) located between said lash adjustment chamber (50) and said control fluid conduit (52), as seen in an intended direction of flow from said control fluid conduit (52) to said lash adjustment chamber (50), said method comprising:

feeding fluid at a first fluid pressure range ($\Delta P_1$) to said control fluid conduit (52) such that a fluid pressure in said control fluid conduit (52) is equal to or lower than a first predetermined threshold pressure level ($P_1$), such that said lash adjustment piston (44) can move relative to said cavity wall (42) in at least a direction towards said lash stop surface (46);

feeding fluid at a second fluid pressure range ($\Delta P_2$) to said control fluid conduit (52) such the fluid pressure in said control fluid conduit (52) is from and including a low second predetermined threshold pressure level ($P_{L2}$) to and including a high second predetermined threshold pressure level ($P_{H2}$), said low second predetermined threshold pressure level (PL2) being greater than said first predetermined threshold pressure level (Pi), such that said lash adjustment piston (44) is prevented from moving relative to said cavity wall (42) in at least the direction towards said lash stop surface (46), and feeding fluid at a third fluid pressure range ($\Delta P_3$) to said control fluid conduit (52) such that the fluid pressure in said control fluid conduit (52) exceeds a third predetermined threshold level ($P_3$), said third predetermined threshold level ($P_3$) being greater than said high second predetermined threshold pressure level ($P_{H2}$), such that said lash adjustment piston (44) can move relative to said cavity wall (42) in at least the direction towards said lash stop surface (46).

* * * * *